US012383080B2

(12) United States Patent
Yoshitsugu

(10) Patent No.: US 12,383,080 B2
(45) Date of Patent: Aug. 12, 2025

(54) FOLDABLE DISPLAY CASE

(71) Applicant: KAWAJUN CO., LTD., Tokyo (JP)

(72) Inventor: Toru Yoshitsugu, Tokyo (JP)

(73) Assignee: KAWAJUN CO., LTD., Tokyo (JP)

( * ) Notice: Subject to any disclaimer, the term of this patent is extended or adjusted under 35 U.S.C. 154(b) by 0 days.

(21) Appl. No.: 18/268,099

(22) PCT Filed: Jan. 30, 2023

(86) PCT No.: PCT/JP2023/002825
§ 371 (c)(1),
(2) Date: Jun. 16, 2023

(87) PCT Pub. No.: WO2024/154361
PCT Pub. Date: Jul. 25, 2024

(65) Prior Publication Data

US 2024/0374053 A1 Nov. 14, 2024

(30) Foreign Application Priority Data

Jan. 18, 2023 (JP) ..... 2023-006111

(51) Int. Cl.
*B65D 5/38* (2006.01)
*A47F 3/00* (2006.01)
*A47F 3/14* (2006.01)

(52) U.S. Cl.
CPC ..... *A47F 3/004* (2013.01); *A47F 3/14* (2013.01)

(58) Field of Classification Search
CPC ..... A47B 87/0207; A47F 3/004; A47F 3/14; A47F 5/10; B65D 5/38; B65D 11/1833
See application file for complete search history.

(56) References Cited

U.S. PATENT DOCUMENTS 4,960,223 A * 10/1990 Chiang ..... B65D 11/1833 220/6
6,142,329 A * 11/2000 Dotan ..... B65D 19/18 220/7

(Continued)

FOREIGN PATENT DOCUMENTS

JP 2013-31547 A 2/2013
KR 10-2159968 B1 9/2020

OTHER PUBLICATIONS

International Search Report dated Mar. 14, 2023, issued in counterpart International Application No. PCT/JP2023/002825. (3 pages).

(Continued)

*Primary Examiner* — James O Hansen
(74) *Attorney, Agent, or Firm* — WHDA, LLP

(57) ABSTRACT

A foldable display case includes: a case main body; first connection portions; second connection portions; first side-wall portions, each configured to be turnable between a first position where the first side-wall portion stands up from the case main body and a second position where the first side-wall portion falls down on the case main body, and each including first engagement portions; second side-wall portions, each configured to be turnable between a third position where the second side-wall portion stands up from the case main body and a fourth position where the second side-wall portion falls down on the case main body, and each including second engagement portions; and joint portions each including third engagement portions engageable with and disengageable from the first engagement portions of the turning first side-wall portion, and fourth engagement portions engageable with and disengageable from the second engagement portions of the turning second side-wall portion.

7 Claims, 24 Drawing Sheets

(56) References Cited

U.S. PATENT DOCUMENTS

| | | | | |
|---|---|---|---|---|
| 8,091,706 | B2 * | 1/2012 | Koefelda | B65D 11/1833 206/506 |
| 2003/0136781 | A1 * | 7/2003 | Rumpel | B65D 21/0201 220/6 |
| 2004/0222222 | A1 * | 11/2004 | Parnall | B65D 11/1833 220/6 |
| 2013/0193153 | A1 * | 8/2013 | Baltz | B65D 25/005 220/666 |
| 2015/0284135 | A1 | 10/2015 | Chinni Vergottini et al. | |
| 2019/0071234 | A1 * | 3/2019 | Apps | B65D 81/261 |
| 2023/0078746 | A1 * | 3/2023 | Sekowski | B65D 21/0213 220/6 |

OTHER PUBLICATIONS

Written Opinion of the International Searching Authority (Form PCT/ISA/237) dated Mar. 14, 2023, issued in counterpart International Application No. PCT/JP2023/002825. (3 pages).

* cited by examiner

FOLDABLE DISPLAY CASE

TECHNICAL FIELD

The present invention relates to a foldable display case in which side walls are foldable.

BACKGROUND ART

For example, a foldable display table also functioning as a storage box is known (for example, see Patent Literature 1). In the case of the display table, commodities are displayed while side walls in a longitudinal direction are folded, which makes it possible to display the commodities to be easily taken up by a customer visiting a store.

CITATION LIST

Patent Literature

[Patent Literature 1]
Japanese Patent Laid-Open No. 2013-31547

SUMMARY OF INVENTION

Technical Problem

The display table is desirably used not only in a state where side walls in the longitudinal direction are folded but also in a state where side walls in a transverse direction are folded. However, in the case of the structure of the above-described existing display table, there is a problem that only the side walls in the transverse direction cannot be folded in terms of the structure.

Accordingly, an object of the present invention is to provide a foldable display case in which a side wall in an optional direction is foldable.

Solution to Problem

The above-described problems are solved by the present invention described below. A foldable display case according to the present invention (1) includes: a case main body having a square plate shape; first connection portions protruding from respective first sides along a transverse direction intersecting a longitudinal direction of the case main body, of an outer edge portion of the case main body; second connection portions protruding from respective second sides along the longitudinal direction, of the outer edge portion; first side-wall portions extending along the transverse direction, each configured to be turnable between a first position where the first side-wall portion stands up from the case main body and a second position where the first side-wall portion falls down on the case main body, around the corresponding first connection portion, and each including first engagement portions; second side-wall portions extending along the longitudinal direction, each configured to be turnable between a third position where the second side-wall portion stands up from the case main body and a fourth position where the second side-wall portion falls down on the case main body, around the corresponding second connection portion, and each including second engagement portions; and joint portions provided at respective corners of the case main body, and each including third engagement portions engageable with and disengageable from the first engagement portions of the turning first side-wall portion, and fourth engagement portions engageable with and disengageable from the second engagement portions of the turning second side-wall portion.

A foldable display case according to the present invention (2) is the foldable display case according to (1) in which either one of the first side-wall portions and the joint portions includes a first latch and a first lever for moving the first latch, and the other of the first side-wall portions and the joint portions includes a first hole portion with which the first latch engages.

A foldable display case according to the present invention (3) is the foldable display case according to (1) or (2) in which either one of the second side-wall portions and the joint portions includes a second latch and a second lever for moving the second latch, and the other of the second side-wall portions and the joint portions includes a second hole portion with which the second latch engages when each of the second side-wall portions is at the third position.

A foldable case according to the present invention (4) is the foldable case according to (1) in which each of the first connection portions includes fifth engagement portions, and the fifth engagement portions engage with the respective second side-wall portions positioned at the fourth position to hold the second side-wall portions at the fourth position.

A foldable case according to the present invention (5) is the foldable case according to (1) or (2) in which the first connection portions protrude up to positions farther from the case main body than the second connection portions, and when each of the first side-wall portions is moved to the second position while the second side-wall portions are at the third position, a front end of each of the first side-wall portions is in contact with the case main body to form a slope going away from the case main body as it goes from the front end toward the corresponding first connection portion.

A foldable case according to the present invention (6) is the foldable case according to (5) further including placement portions provided at respective corners of the case main body and on which the respective joint portions are placed, in which the placement portions protrude from the case main body up to a height equivalent to a height of the first connection portions, and the first connection portions inhibit the joint portions from falling down on the first connection portions together with the second side-wall portions.

A foldable case according to the present invention (7) is the foldable case according to (1) or (2) in which the first connection portions protrude up to positions farther from the case main body than the second connection portions, the first side-wall portions are configured to fall down on the second side-wall portions positioned at the fourth position, and the joint portions are configured to fall down on the second connection portions together with the first side-wall portions.

A foldable case according to the present invention (8) is the foldable case according to (7) in which each of the paired second side-wall portions includes a corner portion extending in the longitudinal direction, the corner portions are in contact with the respective second connection portions when the second side-wall portions are at the third position, and are separated from the case main body when the second side-wall portions are at the fourth position, each of the joint portions includes paired inner surfaces that form an L-shaped cross-section and are substantially orthogonal to each other, and the paired inner surfaces of the joint portions are in contact with the corner portions when the paired second side-wall portions are at the fourth position.

Advantageous Effect of Invention

According to the present invention, it is possible to provide a foldable display case in which a side wall in an optional direction is foldable.

DESCRIPTION OF EMBODIMENT

Figure 1:
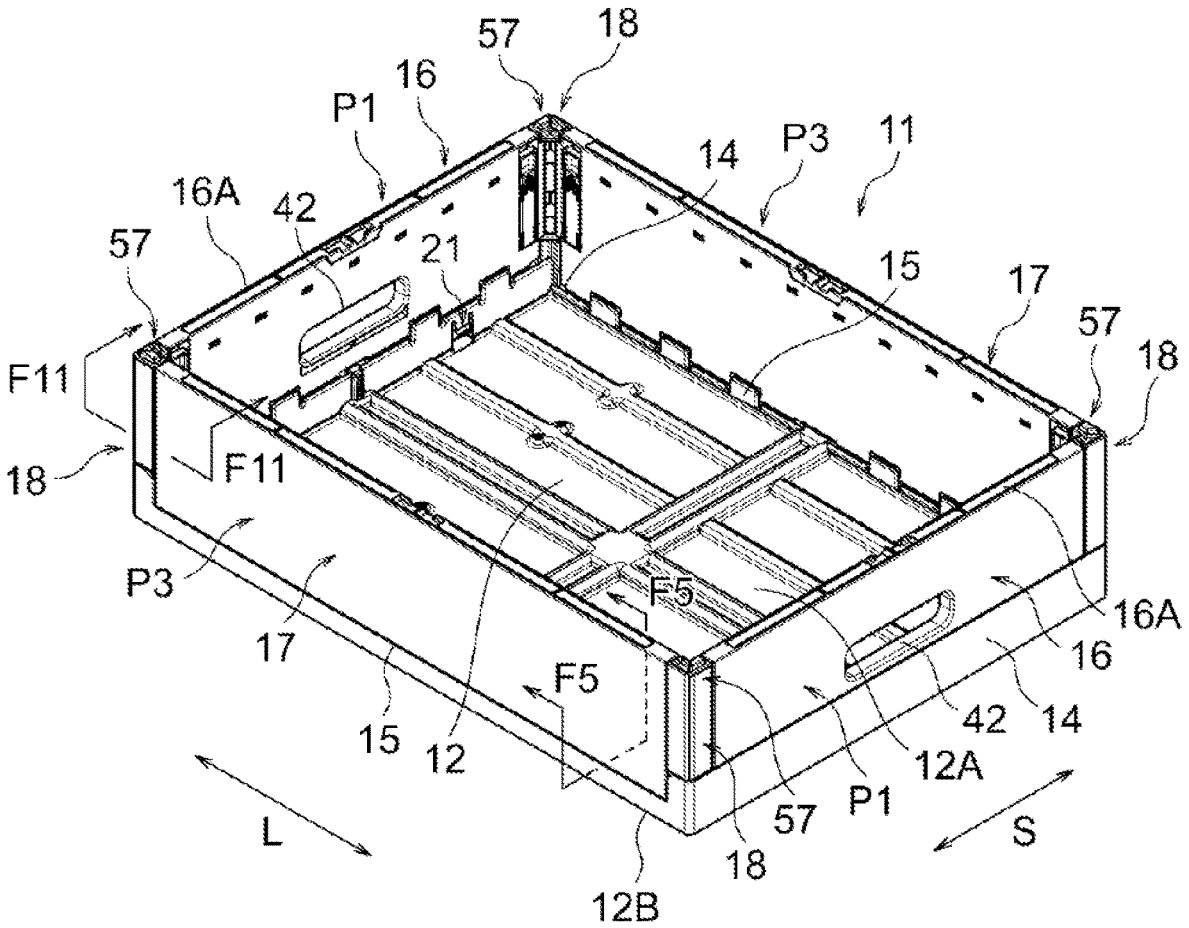
FIG. 1 is a perspective view illustrating a foldable display case according to an embodiment.
Figure 2:
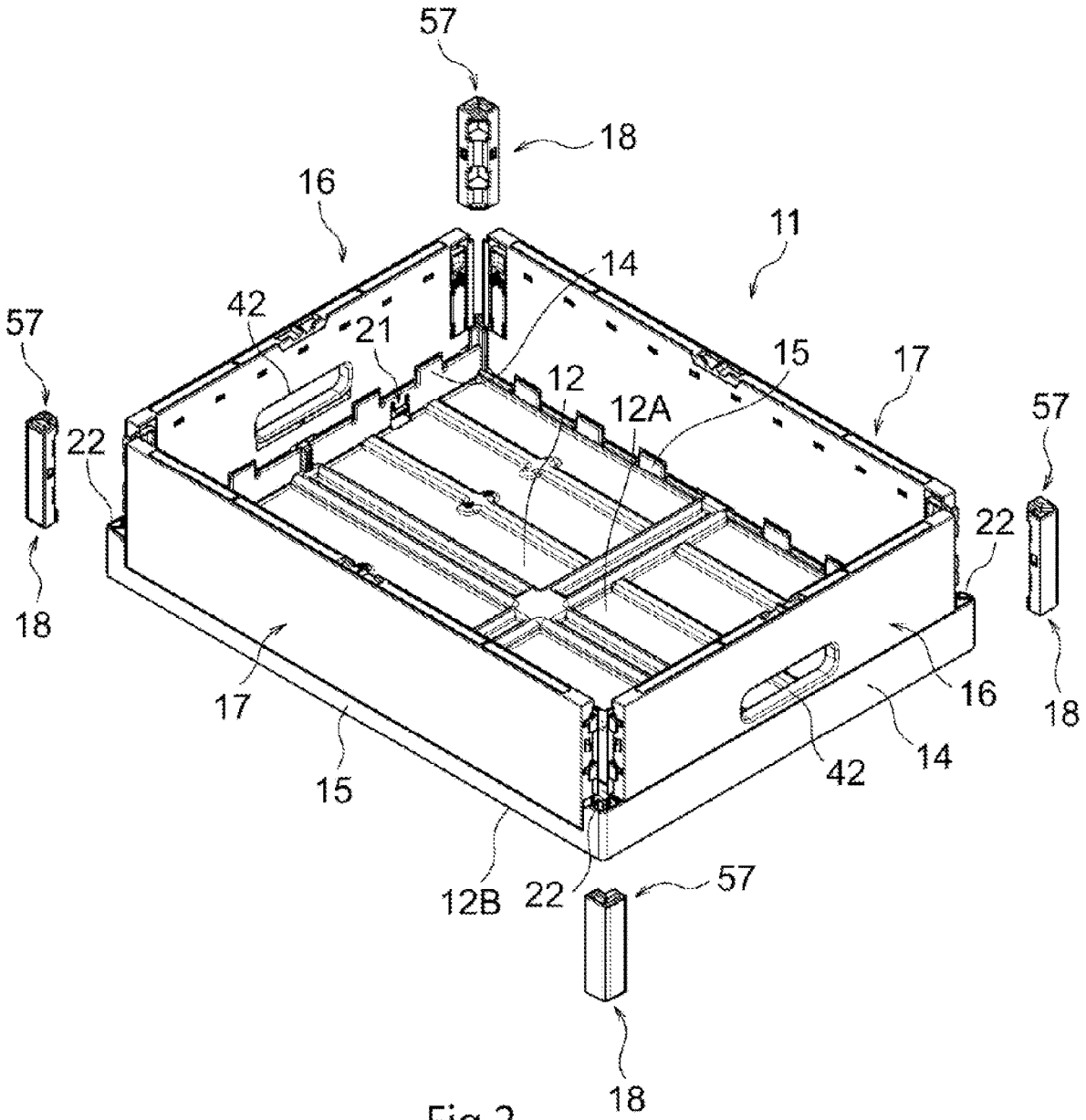
FIG. 2 is a perspective view illustrating a state where joint portions are detached from the foldable display case illustrated in FIG. 1.

An embodiment of a foldable display case according to the present invention is described below with reference to drawings. The foldable display case according to the present invention is used not only to carry in commodities from a vehicle to a backyard of a store, but also to display the commodities by being installed in a sales floor of the store. Further, the foldable display case according to the present invention can be used to display the commodities while only side-wall portions in a transverse direction are folded. In addition, the foldable display case according to the present invention can be used to display the commodities while only side-wall portions in a longitudinal direction are folded, as in the existing display case.

Embodiment

As illustrated in FIG. 1 to FIG. 4, a foldable display case 11 includes: a case main body 12 having a square plate shape; paired first connection portions 14 protruding from respective first sides 13 along a transverse direction S, of an outer edge portion of the case main body 12; paired second connection portions 15 protruding from respective second sides 19 along a longitudinal direction L, of the outer edge portion of the case main body 12; paired first side-wall portions 16 connected to the respective first connection portions 14; paired second side-wall portions 17 connected to the respective second connection portions 15; four joint portions 18 each interposed between the first side-wall portion 16 and the second side-wall portion 17; fifth engagement portions 21 provided in the first connection portions 14; and four placement portions 22 provided at respective corners of the case main body 12. Each of the components of the foldable display case 11 is made of, for example, a synthetic resin material.

Figure 3:
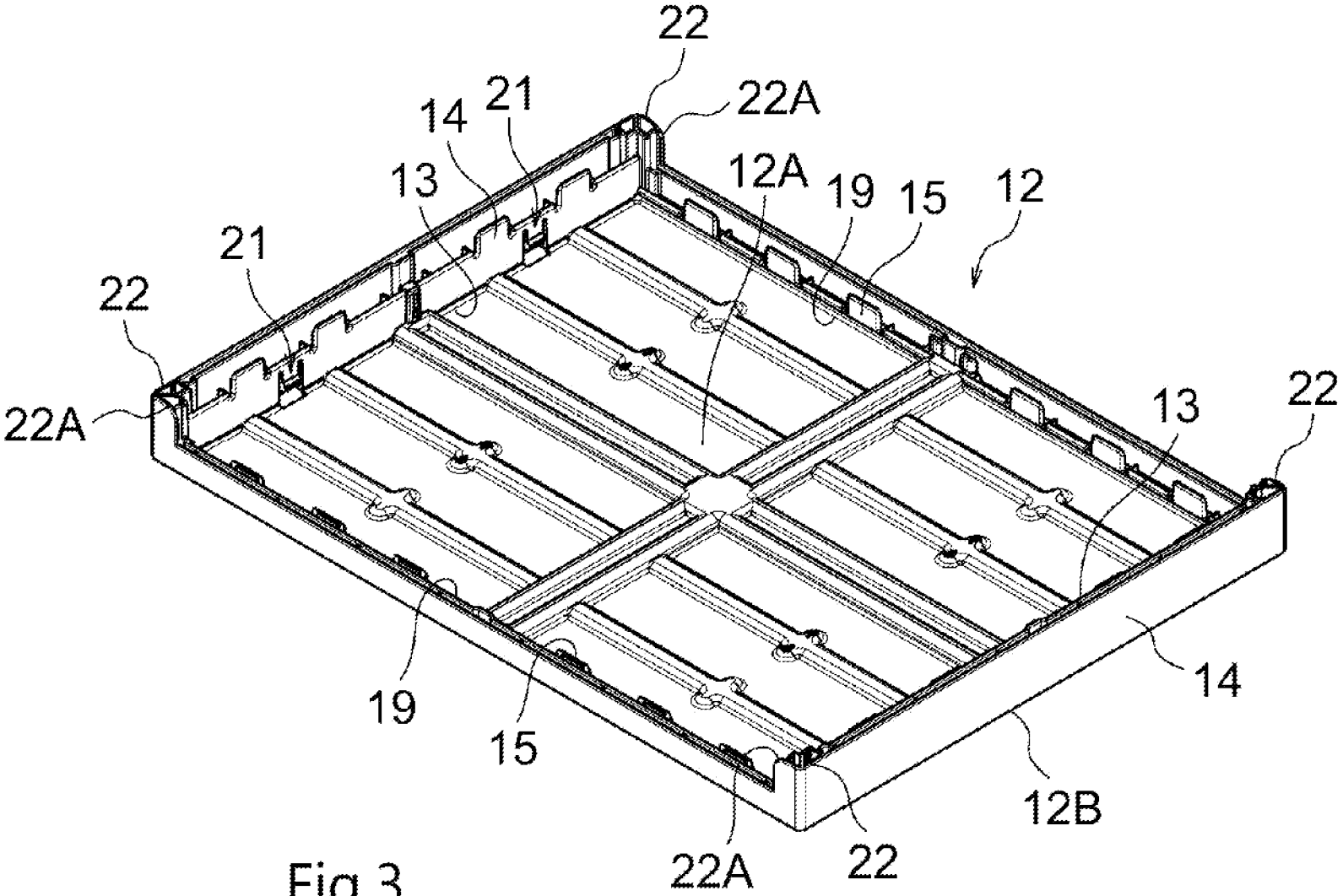
FIG. 3 is a perspective view illustrating a case main body of the foldable display case illustrated in FIG. 1 as viewed from a first surface side.
Figure 4:
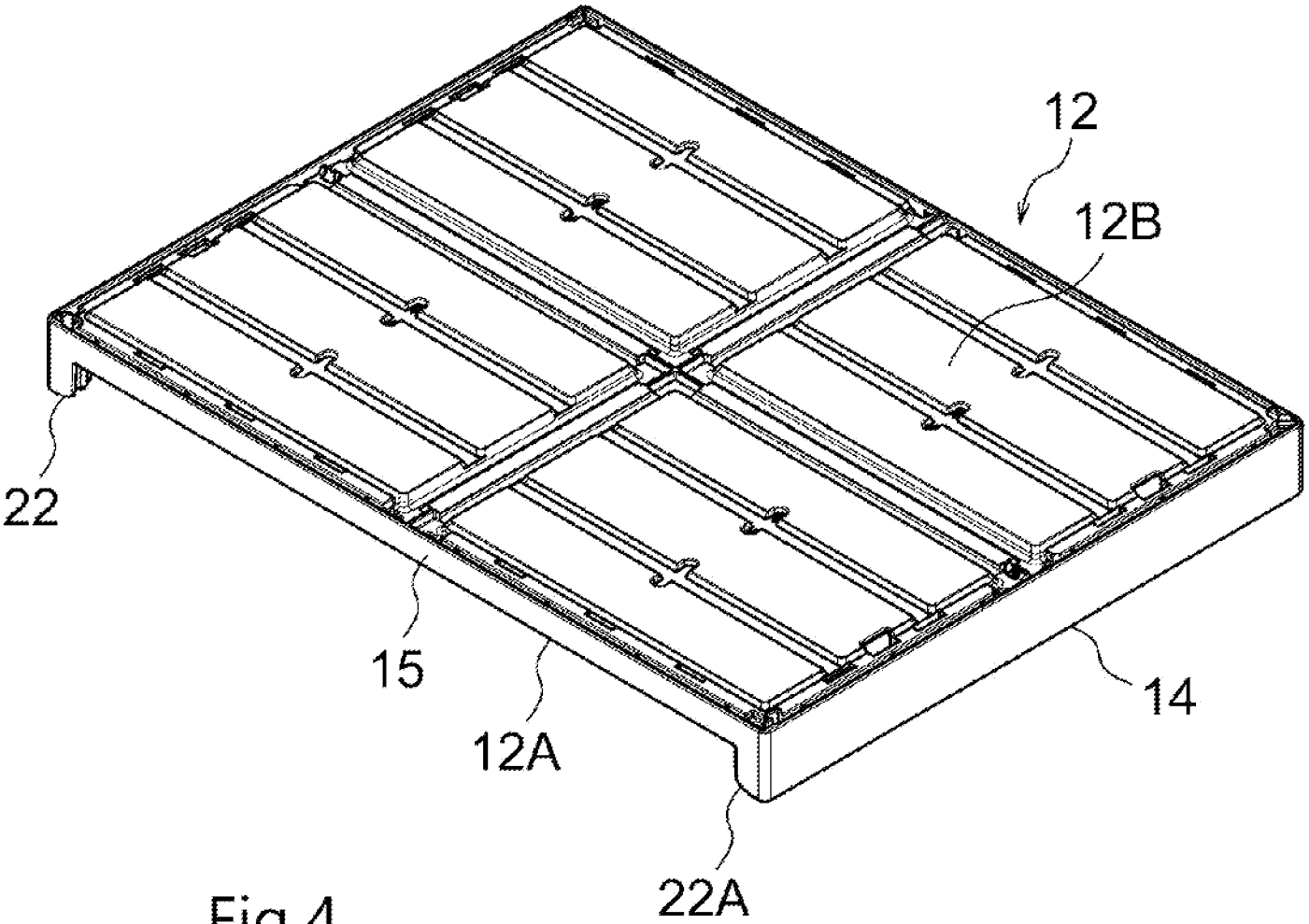
FIG. 4 is a perspective view illustrating the case main body illustrated in FIG. 3 as viewed from a second surface side.

As illustrated in FIG. 3 and FIG. 4, the case main body 12 includes a first surface 12A on a front side and a second surface 12B on a rear side. The paired first connection portions 14 and the paired second connection portions 15 rise from the first surface 12A. Therefore, the first connection portions 14 and the second connection portions 15 form a frame shape rising from the first surface 12A. The first connection portions 14 are formed in the same form. The second connection portions 15 are also formed in the same form.

Figure 5:
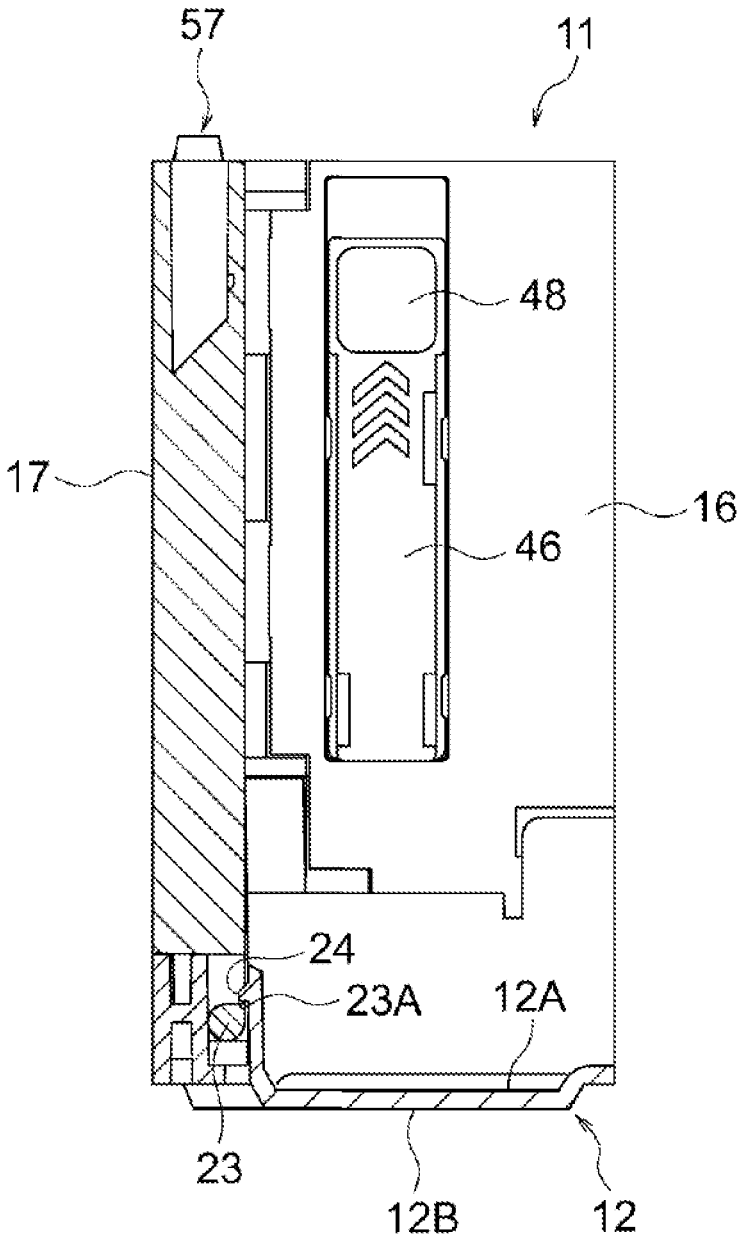
FIG. 5 is a cross-sectional view taken along a position of line F5-F5 illustrated in FIG. 1.

As illustrated in FIG. 5, each of the paired second connection portions 15 is formed in a groove shape into which second shaft portions 23 of the corresponding second side-wall portion 17 are fitted. Each of the second shaft portions 23 of the second side-wall portions 17 has a substantially columnar shape, and partially includes a protrusion 23A. The protrusions 23A engage with respective projections 24 of the second connection portions 15. The second shaft portions 23 of the second side-wall portions 17 are not easily detached from the second connection portions 15 by the projections 24 and the protrusions 23A.

Each of the paired first connection portions 14 has a form similar to the form of each of the second connection portions 15. In other words, each of the first connection portions 14 is formed in a groove shape into which first shaft portions of the corresponding first side-wall portion 16 are fitted. The transverse direction S in which the first connection portions 14 extend is a direction intersecting the longitudinal direction L in which the second connection portions 15 extend. Each of the first connection portions 14 protrudes up to a position farther from the case main body 12 than each of the second connection portions 15.

As illustrated in FIG. 3, each of placement portions 22 is provided so as to rise from the first surface 12A, and is formed so as to be continuous with and at the same protrusion height as the corresponding first connection portion 14. The joint portions 18 are placed on the respective placement portions 22. Each of the placement portions 22 has a rounded portion 22A such that a corner portion on a center part side of the case main body 12 has an arc shape. The joint portions 18 placed on the respective placement portions 22 can easily fall down on the second connection portions 15 by virtue of the rounded portions 22A.

Figure 8:
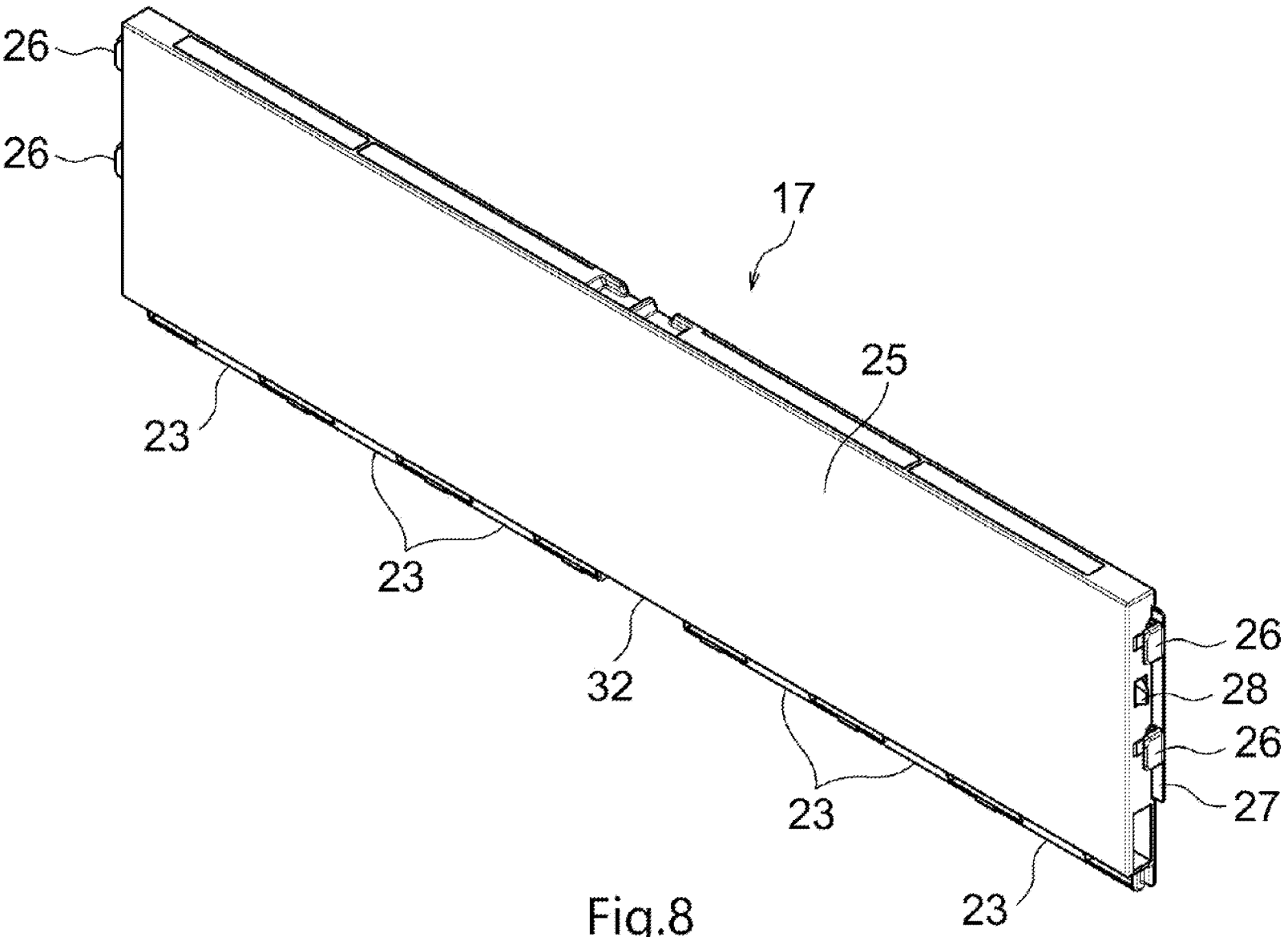
FIG. 8 is a perspective view illustrating a second side-wall portion of the foldable display case illustrated in FIG. 1 as viewed from outside.
Figure 9:
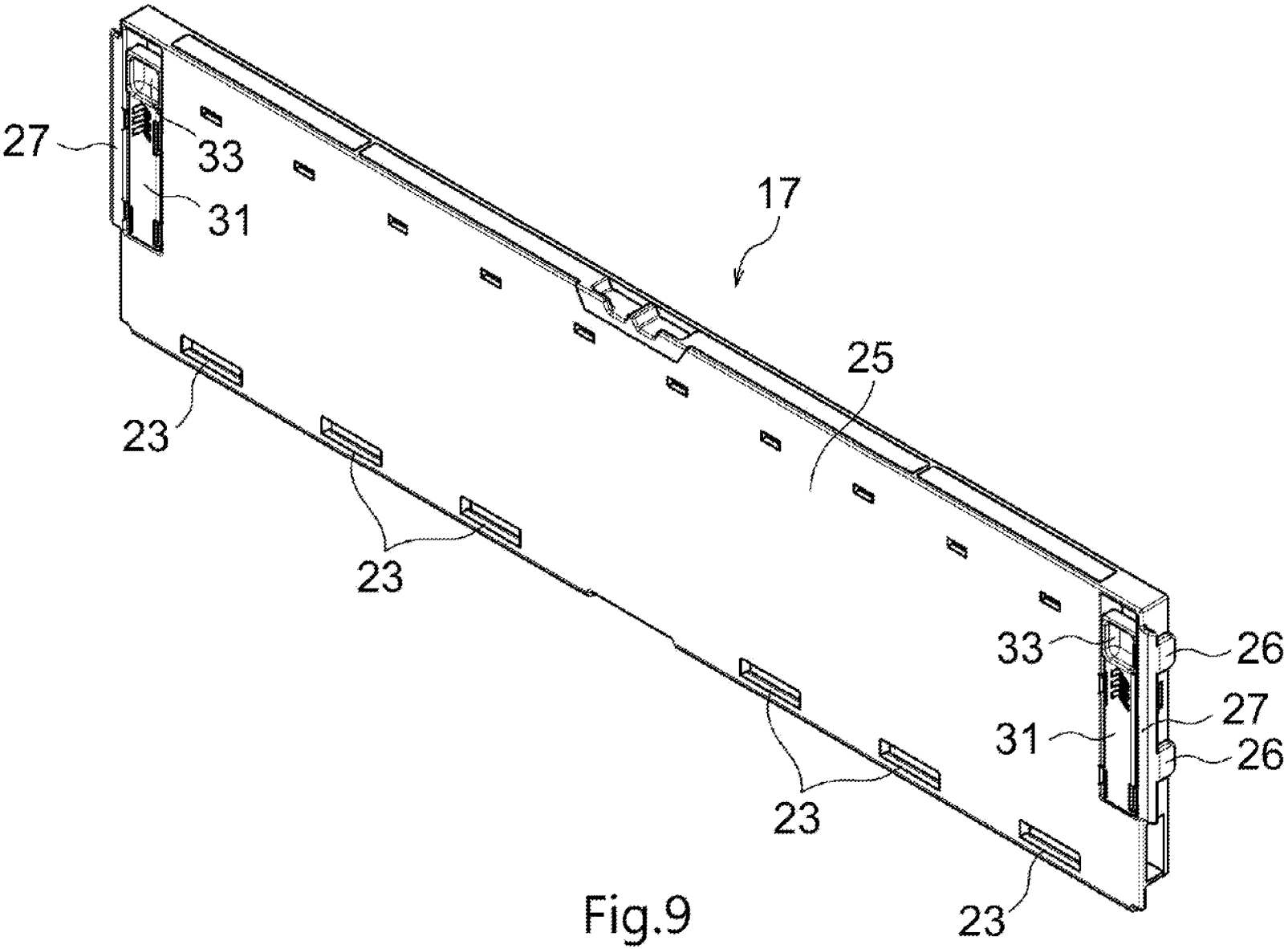
FIG. 9 is a perspective view illustrating the second side-wall portion illustrated in FIG. 8 as viewed from inside.

As illustrated in FIG. 8 and FIG. 9, the paired second side-wall portions 17 are formed in the same form. The second side-wall portions 17 extend along the longitudinal direction L. Each second side-wall portion 17 includes: a second side-wall portion main body 25 having a flat plate shape; upper and lower paired second engagement portions 26 provided on each of side surfaces of the second side-wall portion main body 25; second reinforcing plates 27 each having a flat plate shape and reinforcing the paired second engagement portions 26 so as to couple the paired second engagement portions 26; second latches 28 each provided between the paired second engagement portions 26; second levers 31 retracting the respective second latches 28; and the second shaft portions 23 and a corner portion 32 provided on a lower end of the second side-wall portion main body 25. Each second side-wall portion 17 is turnable between a third position P3 where the second side-wall portion 17 stands up from the case main body 12 and a fourth position P4 where the second side-wall portion 17 falls down on the case main body 12, around the corresponding second connection portion 15 (second shaft portions 23). The corner portion 32 extends in the longitudinal direction L. The corner portion 32 is in contact with the corresponding second connection portion 15 when the second side-wall portion 17 is at the third position P1, and is separated from the case main body 12 when the second side-wall portion 17 is at a second position P2.

Figure 11:
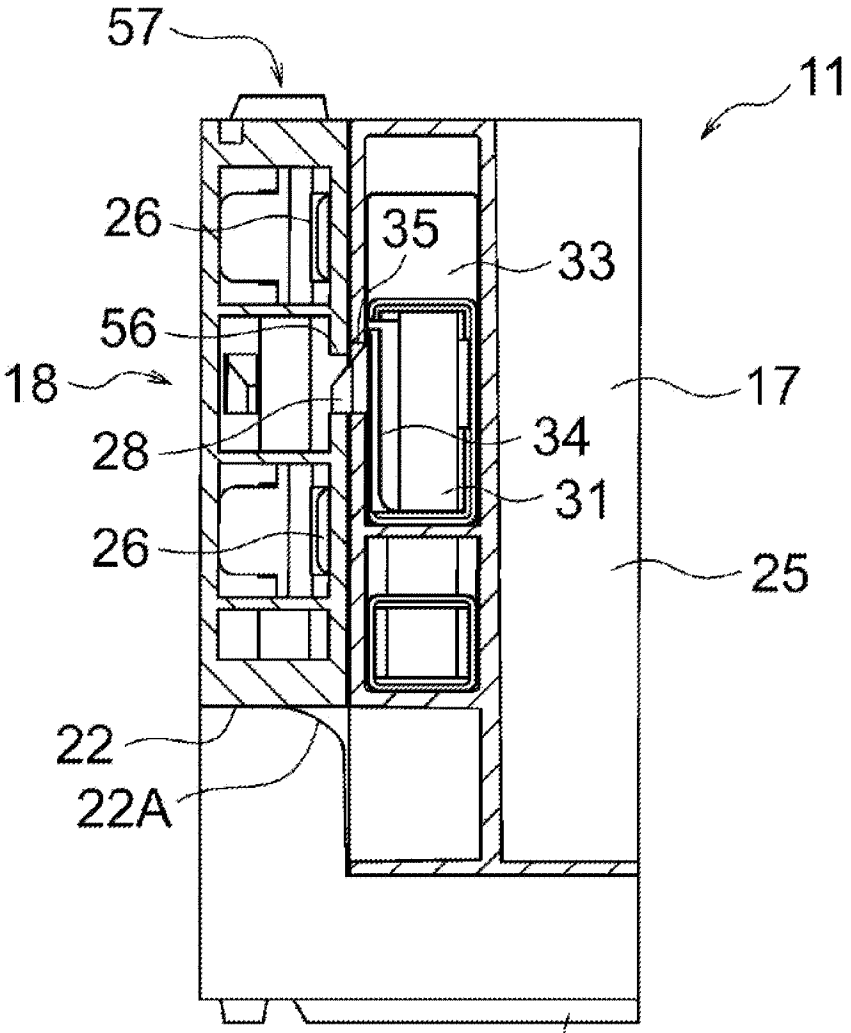
FIG. 11 is a cross-sectional view taken along a position of line F11-F11 of the foldable display case illustrated in FIG. 1.
Figure 12:
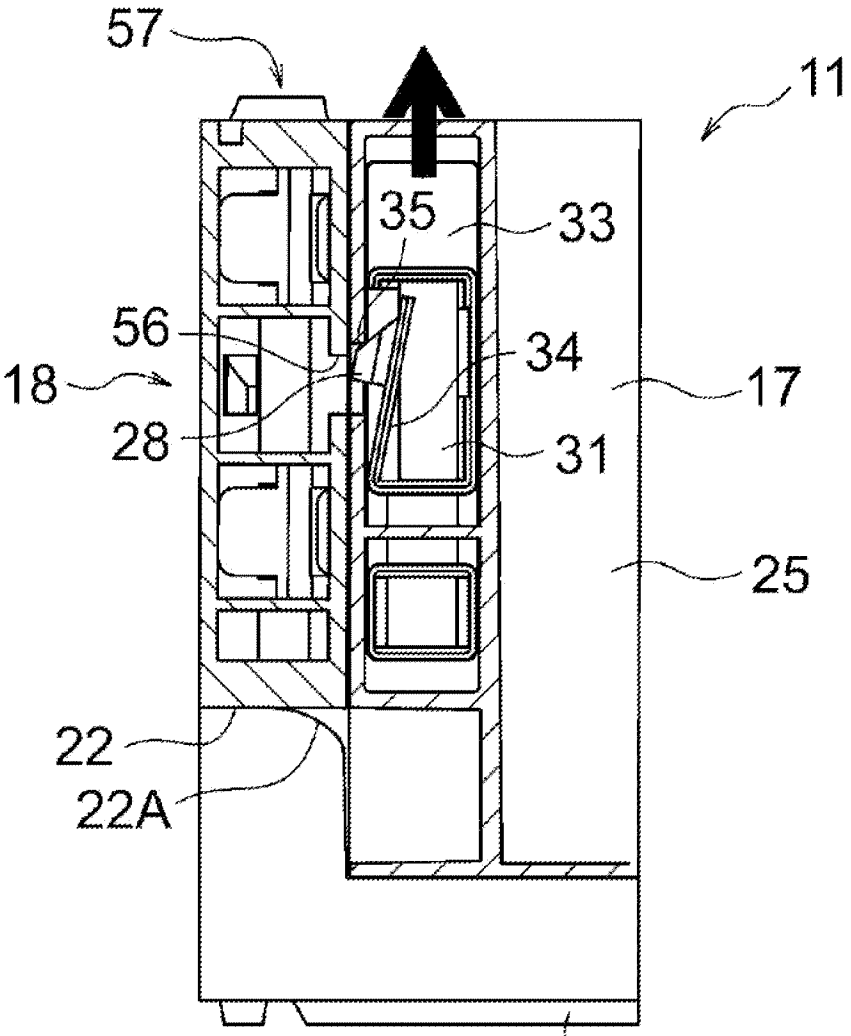
FIG. 12 is a cross-sectional view illustrating a state where, in the foldable display case illustrated in FIG. 11, a second lever is pulled up in an arrow direction, to disengage a second latch from a second hole portion.

Each of the second engagement portions 26 is formed in a hook shape. Front ends of the second engagement portions 26 extend in a thickness direction of the second side-wall portion 17. The second engagement portions 26 are integrally formed with the corresponding second reinforcing plates 27. As illustrated in FIG. 9, FIG. 11, and FIG. 12, each of the second levers 31 includes a second finger hook portion 33, and a second supporting portion 34 supporting the second latch 28 in a cantilever state. The second levers 31 are each integrally made of a synthetic resin material.

The second levers 31 are housed in respective concave portions of the second side-wall portion main body 25 so as to be slidable to the second side-wall portion main body 25. As illustrated in FIG. 11 and FIG. 12, the second latches 28 are integrally formed with the respective second levers 31, and are each formed in a trapezoidal shape. The second latches 28 can be retracted and protrude from respective opening portions 35. As illustrated by an arrow in FIG. 12, when a user pulls the second levers 31 upward through the respective second finger hook portions 33, the second supporting portions 34 are each bent due to relationship between the opening portion 35 and the second latch 28 provided in the second side-wall portion main body 25, thereby retracting the second latches 28 into the second side-wall portion 17. In this state, the user can move the second side-wall portion 17 from the third position P3 to the fourth position P4. In contrast, when the user releases the pulling up of the second levers 31, the second supporting portions 34 are restored to original shapes before being bent. As a result, the second levers 31 are returned to original positions, and the second latches 28 protrude to the outside again. Note that the configuration of the second levers 31 is illustrative, and a configuration in which the second levers 31 are pushed down to retract the respective second latches 28 may be adopted.

To return the second side-wall portion 17 from the fourth position P4 to the third position P3, the second side-wall portion 17 is just moved to the third position P3. At this time, after the second latches 28 are retracted into the second side-wall portion 17 by action of inclined surfaces, the second supporting portions 34 are restored to the original shapes and the second latches 28 accordingly protrude again. As a result, the second latches 28 engage with respective second hole portions 56 of the joint portions 18, and the second side-wall portion 17 is held at the third position P3.

Figure 6:
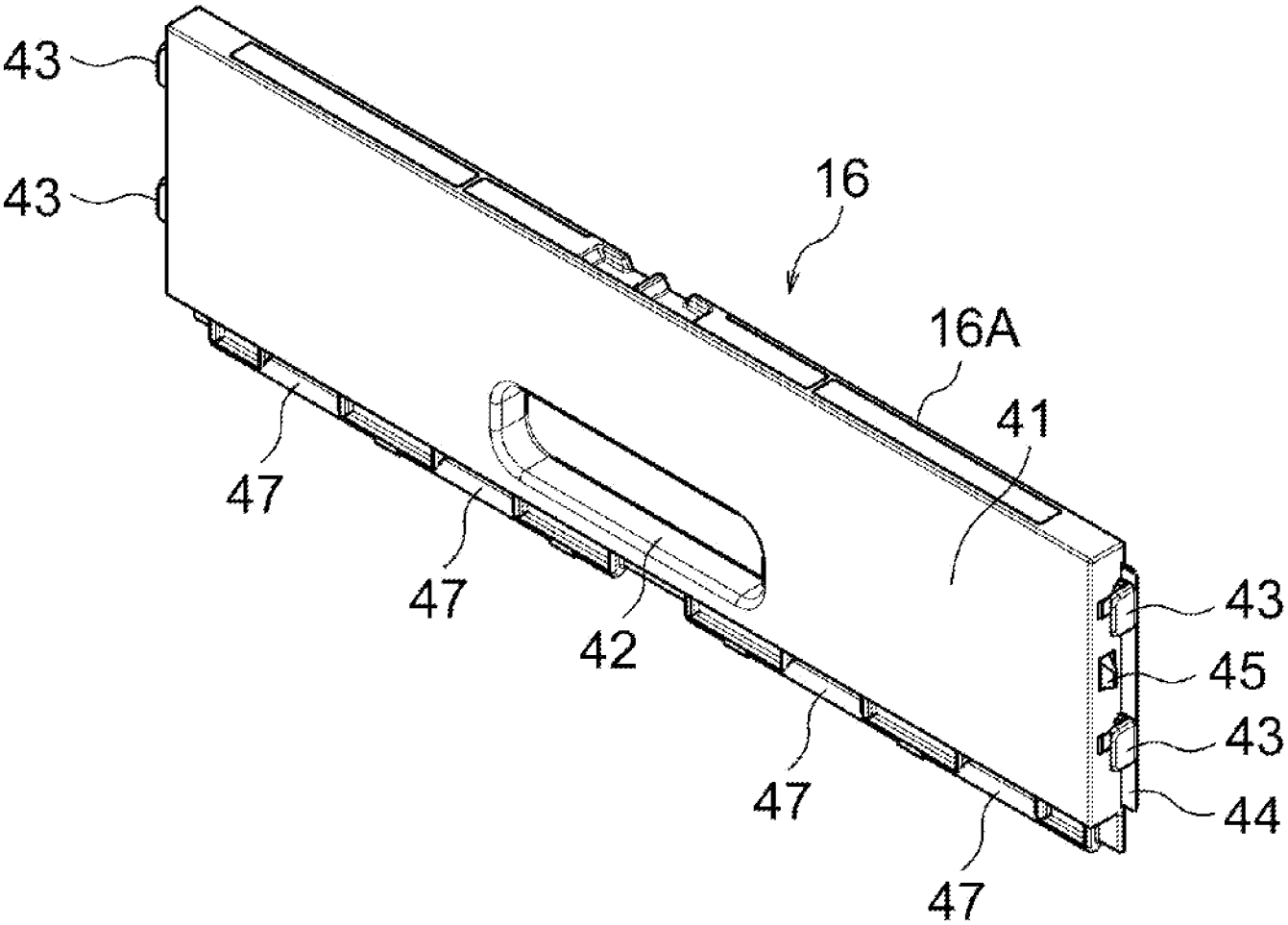
FIG. 6 is a perspective view illustrating a first side-wall portion of the foldable display case illustrated in FIG. 1 as viewed from outside.
Figure 7:
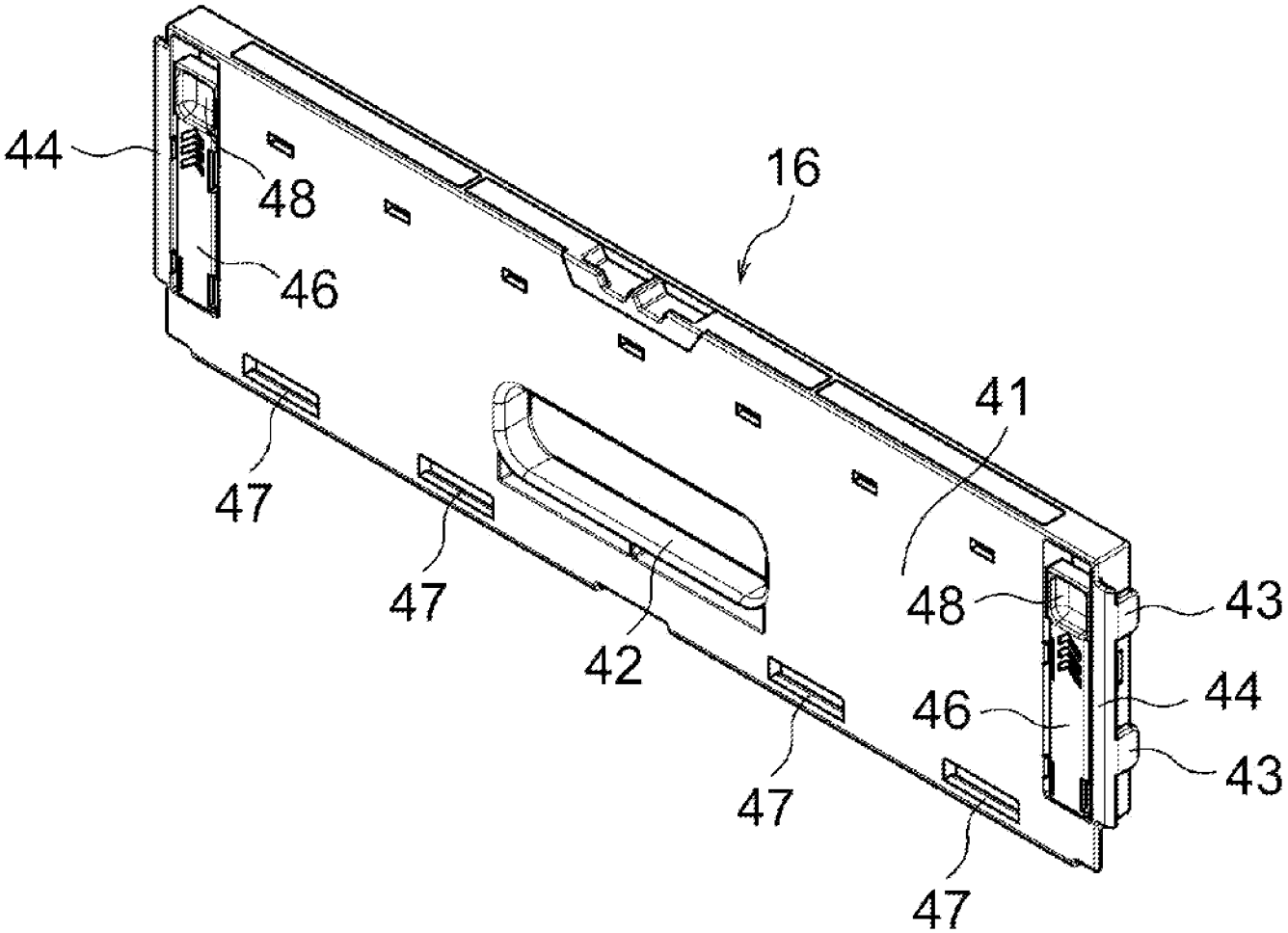
FIG. 7 is a perspective view illustrating the first side-wall portion illustrated in FIG. 6 as viewed from inside.

As illustrated in FIG. 6 and FIG. 7, the paired first side-wall portions 16 are formed in the same form. The first side-wall portions 16 extend along the transverse direction S. The first side-wall portions 16 are different from the second side-wall portions 17 in that each of the first side-wall portions 16 has a length dimension different from a length dimension of each of the second side-wall portions 17, and includes a handle portion 42; however, the other configurations are substantially similar to the configurations of the second side-wall portions 17.

Each first side-wall portion 16 includes: a first side-wall portion main body 41 having a flat plate shape; the handle portion 42 provided at a lower center part of the first side-wall portion main body 41; upper and lower paired first engagement portions 43 provided on each of side surfaces of the first side-wall portion main body 41; first reinforcing plates 44 each reinforcing the paired first engagement portions 43 so as to couple the paired first engagement portions 43; first latches 45 each provided between the paired first engagement portions 43; first levers 46 retracting the respective first latches 45; and first shaft portions 47 provided at a lower end of the first side-wall portion main body 41. Each first side-wall portion 16 is turnable between a first position P1 where the first side-wall portion 16 stands up from the case main body 12 and the second position P2 where the first side-wall portion 16 falls down on the case main body 12, around the corresponding first connection portion 14 (first shaft portions 47).

Each of the first engagement portions 43 is formed in a hook shape. Front ends of the first engagement portions 43 extend in a thickness direction of the first side-wall portion 16. The first engagement portions 43 are integrally formed with the corresponding first reinforcing plates 44. Each of the first levers 46 includes a first finger hook portion 48, and a first supporting portion supporting the first latch 45 in a cantilever state. The first levers 46 are each integrally made of a synthetic resin material.

The first levers 46 are housed in respective concave portions of the first side-wall portion main body 41 so as to be slidable to the first side-wall portion main body 41. The first latches 45 are integrally formed with the respective first levers 46, and are each formed in a trapezoidal shape. The first latches 45 can be retracted and protrude from the respective opening portions 35. When the user pulls the first levers 46 upward through the respective first finger hook portions 48, the first supporting portions similar to the second supporting portions 34 are bent due to relationship between the opening portion 35 and the first latch 45, thereby retracting the first latches 45 into the first side-wall portion 16. In this state, the user can move the first side-wall portion 16 from the first position P1 to the second position P2. In contrast, when the user releases the pulling up of the first levers 46, the first supporting portions are restored to original shapes before being bent. As a result, the first latches 45 protrude to the outside again. Note that the configuration of the first levers 46 is illustrative, and a configuration in which the first levers 46 are pushed down to retract the second latches 28 may be adopted.

To return the first side-wall portion 16 from the second position P2 to the first position P1, the first side-wall portion 16 is just moved to the first position P1. At this time, after the first latches 45 are retracted into the first side-wall portion 16 by action of inclined surfaces, the first supporting portions are restored to the original shapes and the first latches 45 accordingly protrude again. As a result, the first latches 45 engage with respective first hole portions 55 of the joint portions 18, and the first side-wall portion 16 is held at the first position P1.

Figure 10:
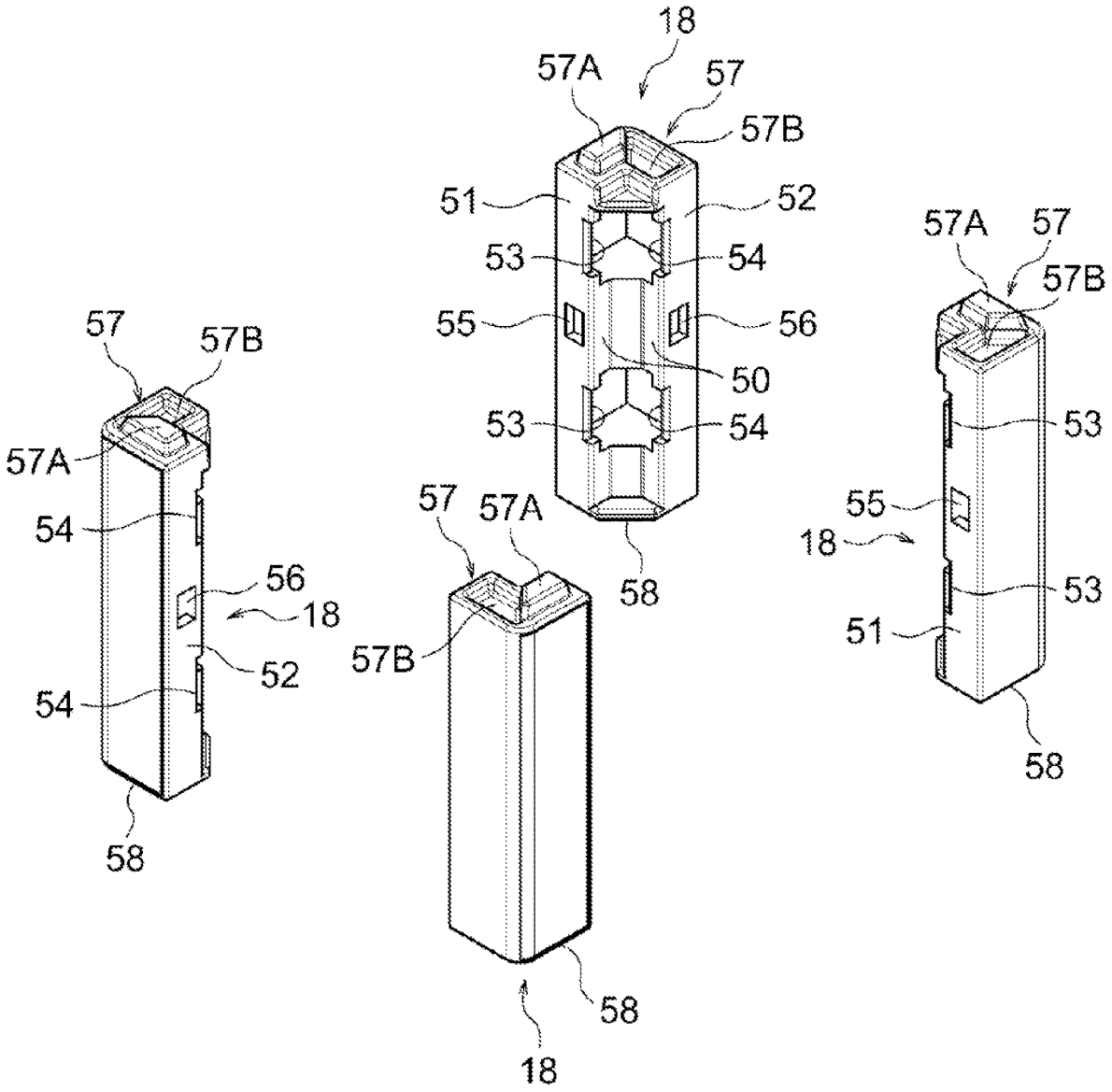
FIG. 10 is a perspective view illustrating four joint portions in total of the foldable display case illustrated in FIG. 1.

As illustrated in FIG. 10, the four joint portions 18 are formed in the same form. The joint portions 18 are provided at the corners of the case main body 12. Each of the joint portions 18 has an "L" shape as viewed from above, and is formed in a columnar shape extending in a direction intersecting the first surface 12A of the case main body 12. Each joint portion 18 includes: paired inner surfaces 50; a first wall 51 facing the adjacent first side-wall portion 16; a second wall 52 facing the adjacent second side-wall portion 17; third engagement portions 53 engaging with the first engagement portions 43 of the adjacent first side-wall portion 16; fourth engagement portions 54 engaging with the second engagement portions 26 of the adjacent second side-wall portion 17; the first hole portion 55 provided in the first wall 51 and engaging with the first latch 45 of the adjacent first side-wall portion 16; the second hole portion 56 provided in the second wall 52 and engaging with the second latch 28 of the adjacent second side-wall portion 17; the positioning portion 57 provided at a top part: and a flat surface 58 provided on a bottom part.

The third engagement portions 53 are formed in hole shapes into which the respective first engagement portions 43 each having a hook shape are inserted. The third engagement portions 53 can engage with and disengage from the first engagement portions 43 of the turning first side-wall portion 16. The fourth engagement portions 54 are formed in hole shapes into which the respective second engagement portions 26 each having a hook shape are inserted. The fourth engagement portions 54 can engage with and disengage from the second engagement portions 26 of the turning second side-wall portion 17. In the present embodiment, each of the third engagement portions 53 and the corresponding fourth engagement portion 54 are formed as an integrated cavity.

The first hole portion 55 is formed as a through hole penetrating through the first wall 51. The second hole portion 56 is formed as a through hole penetrating through the second wall 52. Note that, in the present embodiment, the first latches 45 and the first levers 46 are provided in each of the first side-wall portions 16, and the first hole portion 55 is provided in each of the joint portions 18; however, the arrangement is not limited thereto. The first latch 45 and the first lever 46 may be provided in each of the joint portions 18, and the first hole portions 55 may be provided in each of the first side-wall portions 16.

Likewise, in the present embodiment, the second latches 28 and the second levers 31 are provided in each of the second side-wall portions 17, and the second hole portion 56 is provided in each of the joint portions 18; however, the arrangement is not limited thereto. The second latch 28 and the second lever 31 may be provided in each of the joint portions 18, and the second hole portions 56 may be provided in each of the second side-wall portions 17.

Each of the positioning portions 57 includes a convex portion 57A and a concave portion 57B at adjacent positions. The positioning portions 57 constitute guides so as to enable the foldable display case 11 to be placed at a correct position when the foldable display case 11 in a normal use state where the first side-wall portions 16 and the second side-wall portions 17 are placed on the upper side is placed on the other foldable display case 11 in the normal use state where the first side-wall portions 16 and the second side-wall portions 17 are placed on the upper side.

Likewise, the positioning portions 57 enable the foldable display case 11 in an upside-down state where the first side-wall portions 16 and the second side-wall portions 17 are placed on the lower side, to be installed on the foldable display case 11 in the normal use state where the first side-wall portions 16 and the second side-wall portions 17 are placed on the upper side, by virtue of shapes each obtained by combining the convex portion 57A and the concave portion 57B.

Figure 15:
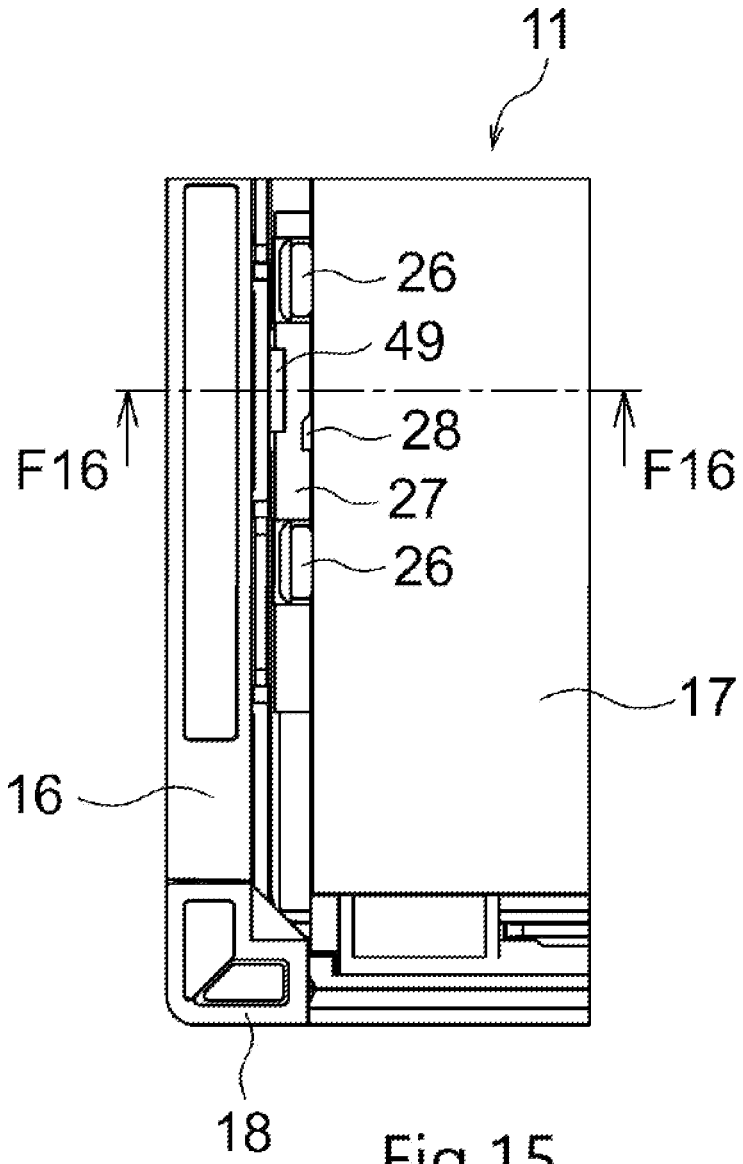
FIG. 15 is a plan view of the foldable display case illustrated in FIG. 13 as viewed from above.
Figure 16:
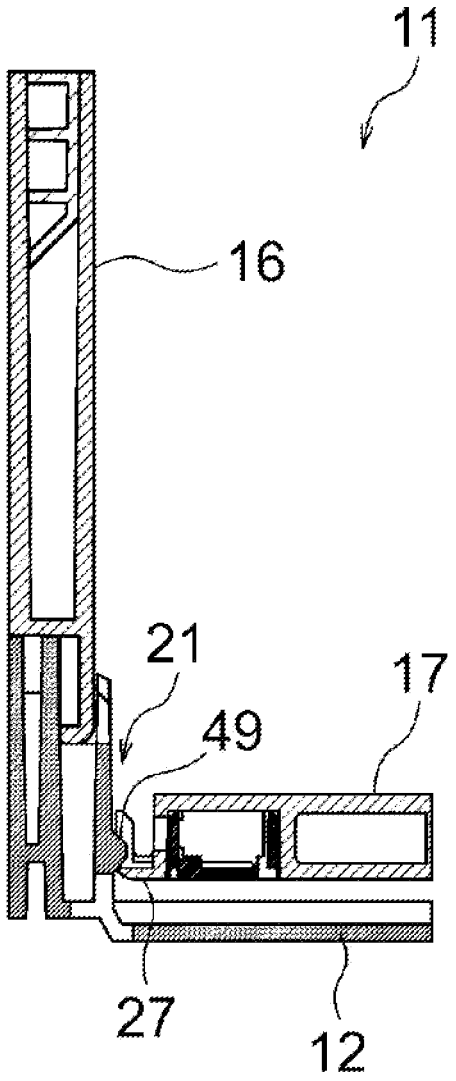
FIG. 16 is a cross-sectional view taken along a position of line F16-F16 of the foldable display case illustrated in FIG. 15.

As illustrated in FIG. 3, the fifth engagement portions 21 are provided at positions close to the case main body 12 (first surface 12A), in the first connection portions 14. As illustrated in FIG. 3, FIG. 15, and FIG. 16, each of the fifth engagement portions 21 is formed in a tongue shape protruding downward, and exerts flexibility at a front end side. Each of the fifth engagement portions 21 includes, at the front end part of the tongue shape, a locking projection 49 to lock the second reinforcing plate 27 of the corresponding side-wall portion 17.

Subsequently, action of the foldable display case 11 according to the present embodiment is described with reference to FIG. 1, FIGS. 11 to 13, and FIGS. 15 to 17.

As illustrated in FIG. 1, in a state where the foldable display case 11 is set up as a box, the user can put commodities in the foldable display case 11 and transport the commodities, or can install the foldable display case 11 storing the commodities in a store to display the commodities. At this time, the user can carry the foldable display case 11 by using the handle portions 42.

Figure 13:
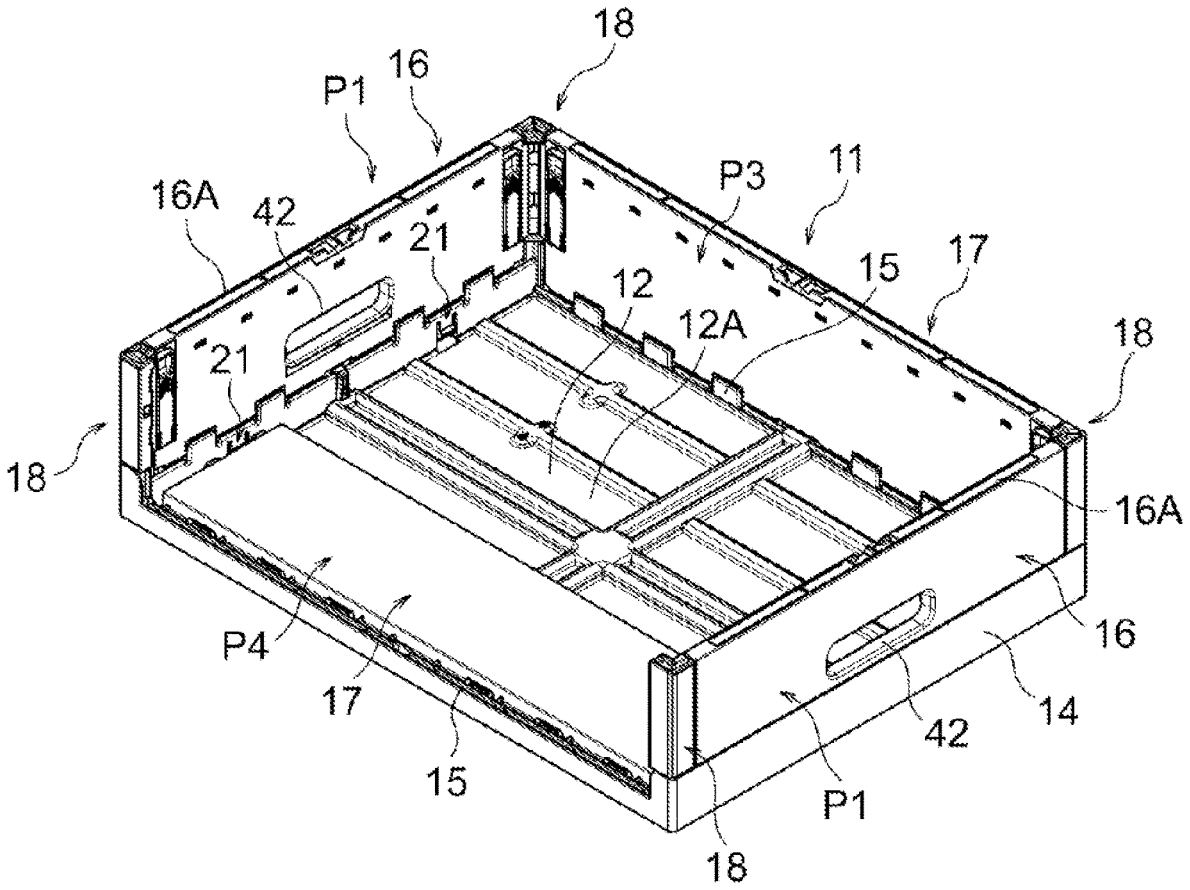
FIG. 13 is a perspective view illustrating a state after one of paired second side-wall portions is moved to a fourth position in the foldable display case illustrated in FIG. 1.

As illustrated in FIG. 13, commodities can be displayed while only one of the paired second side-wall portions 17 of the foldable display case 11 is moved from the third position P3 to the fourth position P4. At this time, the user releases engagement by the second latches 28 by pulling up the second levers 31 of the second side-wall portion 17, and moves the second side-wall portion 17 from the third position P3 to the fourth position P4. At this time, engagement between the second engagement portions 26 of the second side-wall portion 17 and the fourth engagement portions 54 of the joint portions 18 is released. Further, when the second reinforcing plates 27 get over the respective locking projections 49 of the fifth engagement portions 21, the second side-wall portion 17 is held at the fourth position P4 by the fifth engagement portions 21.

Figure 18:
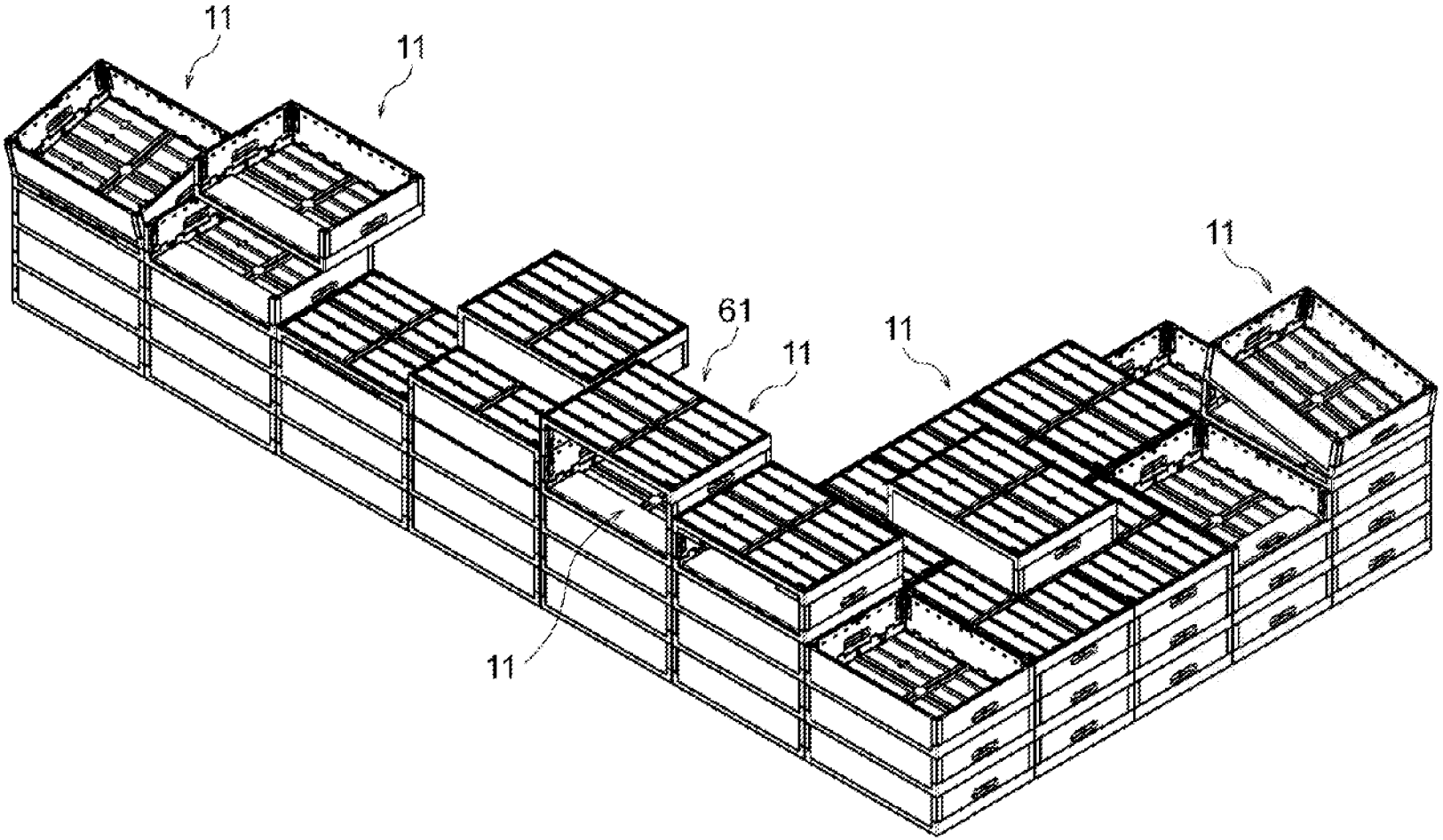
FIG. 18 is a perspective view illustrating foldable display cases in a plurality of use modes including a first special use mode 61.

Accordingly, for example, as in the first special use mode 61 illustrated in FIG. 18, the foldable display case 11 in the upside-down state where the first side-wall portions 16 and the second side-wall portions 17 are placed on the lower side can be installed on the foldable display case 11 in the normal use state where the first side-wall portions 16 and the second side-wall portions 17 are placed on the upper side. Even in this case, in the foldable display case 11 in the upside-down state, a defect in which the second side-wall portion 17 returns from the fourth position P4 to the third position P3 by action of the gravity does not occur. This makes it possible to realize commodity display in which the front side is largely opened.

To return the second side-wall portion 17 from the fourth position P4 to the third position P3, the user raises the second side-wall portion 17 by a hand. As a result, the front ends of the fifth engagement portions 21 are bent and retracted, and the second reinforcing plates 27 can get over the respective locking projections 49 of the fifth engagement portions 21. Each of the second latches 28 of the second side-wall portion 17 has an inclined surface so as to be gradually reduced in protrusion height as the position is changed from the fourth position P4 to the third position P3. Therefore, when the user returns the second side-wall portion 17 from the fourth position P4 to the third position P3 without being conscious of presence of the second latches 28, the second latches 28 are automatically retracted into the second side-wall portion 17, and then return to the original protrusion states to engage with the second hole portions 56 of the joint portions 18. As a result, the second side-wall portion 17 is held at the third position P3.

Figure 14:
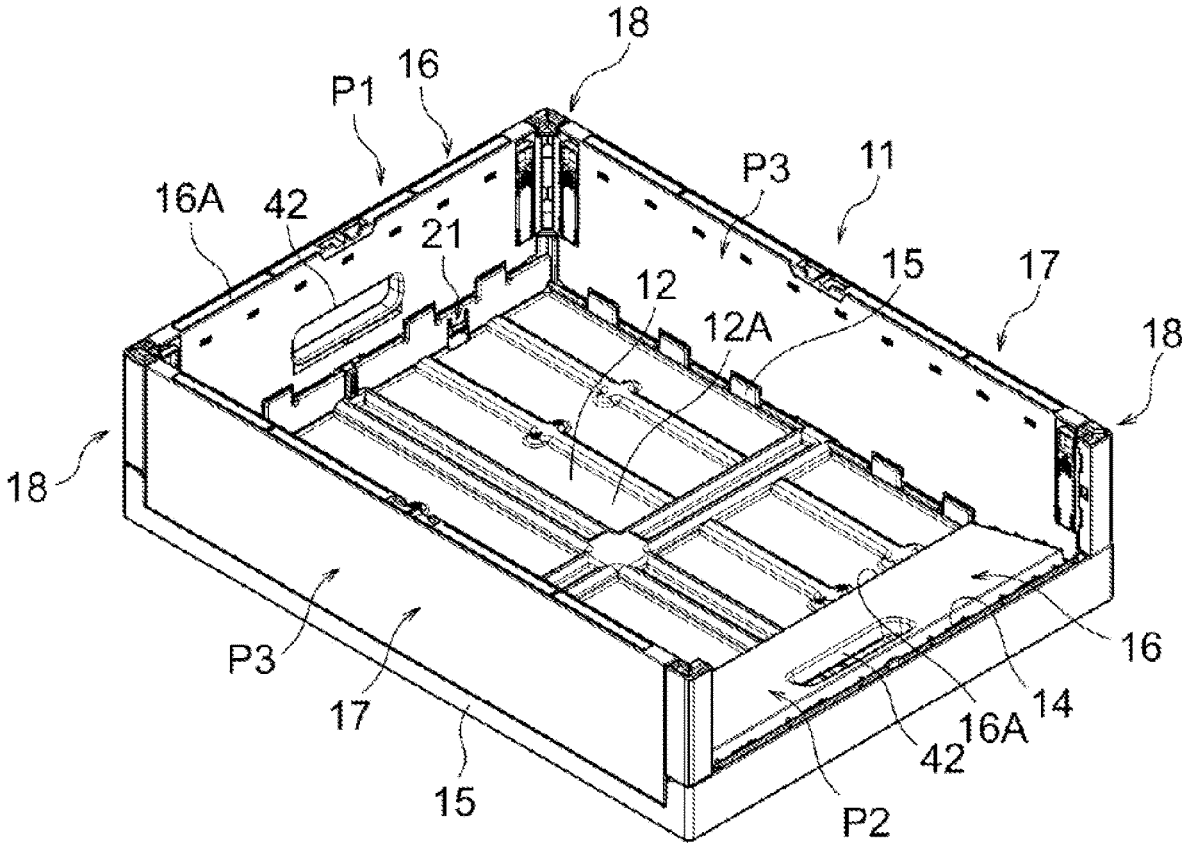
FIG. 14 is a perspective view illustrating a state where one of paired first side-wall portions is moved to a second position in the foldable display case illustrated in FIG. 1.

As illustrated in FIG. 14, commodities can be displayed while only one of the paired first side-wall portions 16 of the foldable display case 11 according to the present embodiment is moved from the first position P1 to the second position P2. At this time, the user releases engagement by the first latches 45 by pulling up the first levers 46 of the first side-wall portion 16, and moves the first side-wall portion 16 from the first position P1 to the second position P2. At this time, since the first connection portion 14 protrudes up to the position farther from the case main body 12 than the second connection portions 15 as obvious from FIG. 14, the first side-wall portion 16 at the second position P2 forms a slope. In other words, the first side-wall portion 16 is in contact with the case main body 12 at a front end 16A, to form the slope going away from the case main body 12 as it goes from the front end 16A toward the first connection portion 14.

In such a use mode, for example, when elongated commodities such as Japanese radishes, burdocks, and green onions are displayed, the elongated commodities can be displayed while being partially placed on the slope.

To return the first side-wall portion 16 from the second position P2 to the first position P1, it is sufficient for the user to move the first side-wall portion 16 from the second position P2 to the first position P1. Each of the first latches 45 of the first side-wall portion 16 has an inclined surface so as to be gradually reduced in protrusion height as the position is moved from the second position P2 to the first position P1. Therefore, when the user returns the first side-wall portion 16 from the second position P2 to the first position P1 without being conscious of presence of the first latches 45, the first latches 45 are automatically retracted into the first side-wall portion 16, and then return to the original protrusion states to engage with the first hole portions 55 of the joint portions 18. As a result, the first side-wall portion 16 is held at the first position P1.

Figure 17:
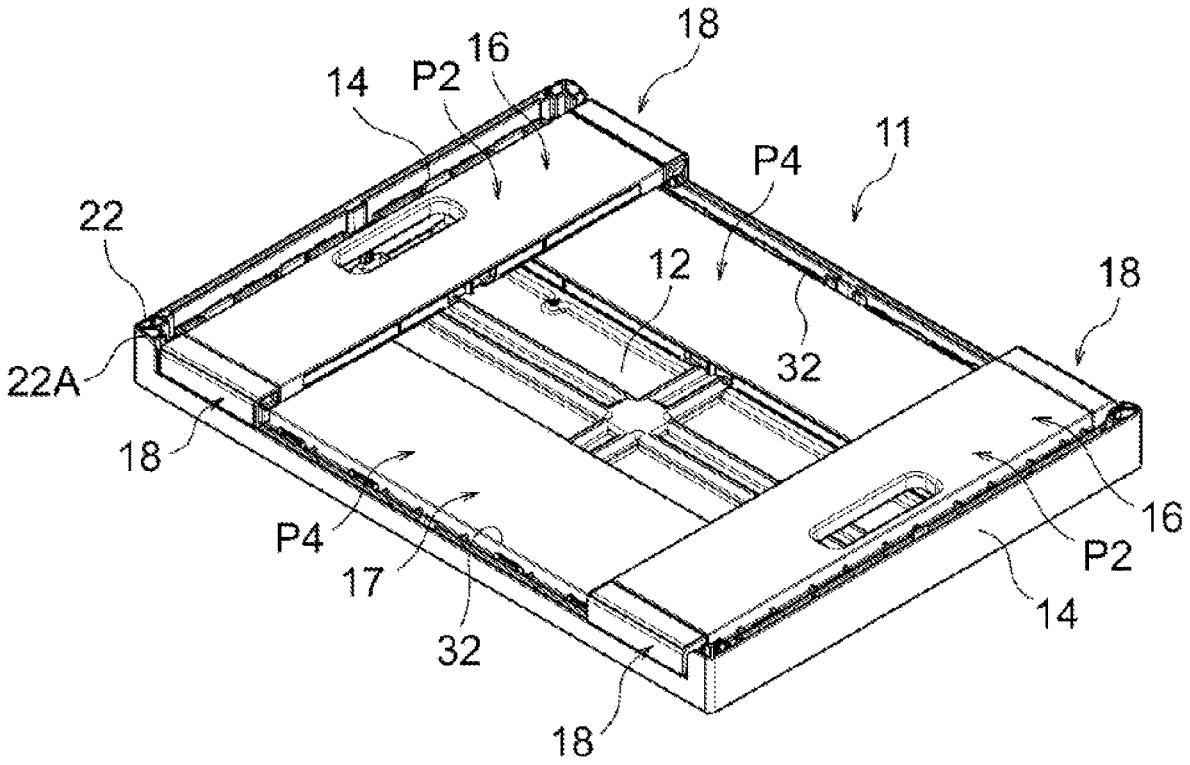
FIG. 17 is a perspective view illustrating a folded state where the first side-wall portions and the second side-wall portions of the foldable display case illustrated in FIG. 1 fall down on the case main body.

As illustrated in FIG. 17, the foldable display case 11 can be put into a folded state. More specifically, by a method similar to the above-described method of moving the second side-wall portion 17 from the third position P3 to the fourth position P4, each of the paired second side-wall portions 17 is moved from the third position P3 where the second side-wall portion 17 stands up to the fourth position P4 where the second side-wall portion 17 falls down on the case main body 12. Further, each of the first side-wall portions 16 is moved from the first position P1 to the second position P2 so as to fall down on the second side-wall portions 17. At this time, the first side-wall portions 16 and the joint portions 18 are smoothly moved from the first position P1 to the second position P2 by virtue of the rounded portions of the placement portions 22. At this time, the paired inner surfaces 50 of the joint portions 18 are in contact with the corner portion 32 of the first side-wall portions 16 at the second position P2.

On the other hand, a folded form of the foldable display case 11 in which the second side-wall portions 17 are positioned on the first side-wall portions 16 is prohibited. More specifically, as illustrated in FIG. 14, in the state where the first side-wall portions 16 are at the second position P2, the second side-wall portions 17 do not fall down on the first side-wall portions 16 because the joint portions 18 serve as stoppers. As a result, occurrence of a defect in which the first side-wall portions 16 placed on the lower side are damaged by a load is prevented as much as possible.

Figure 19:
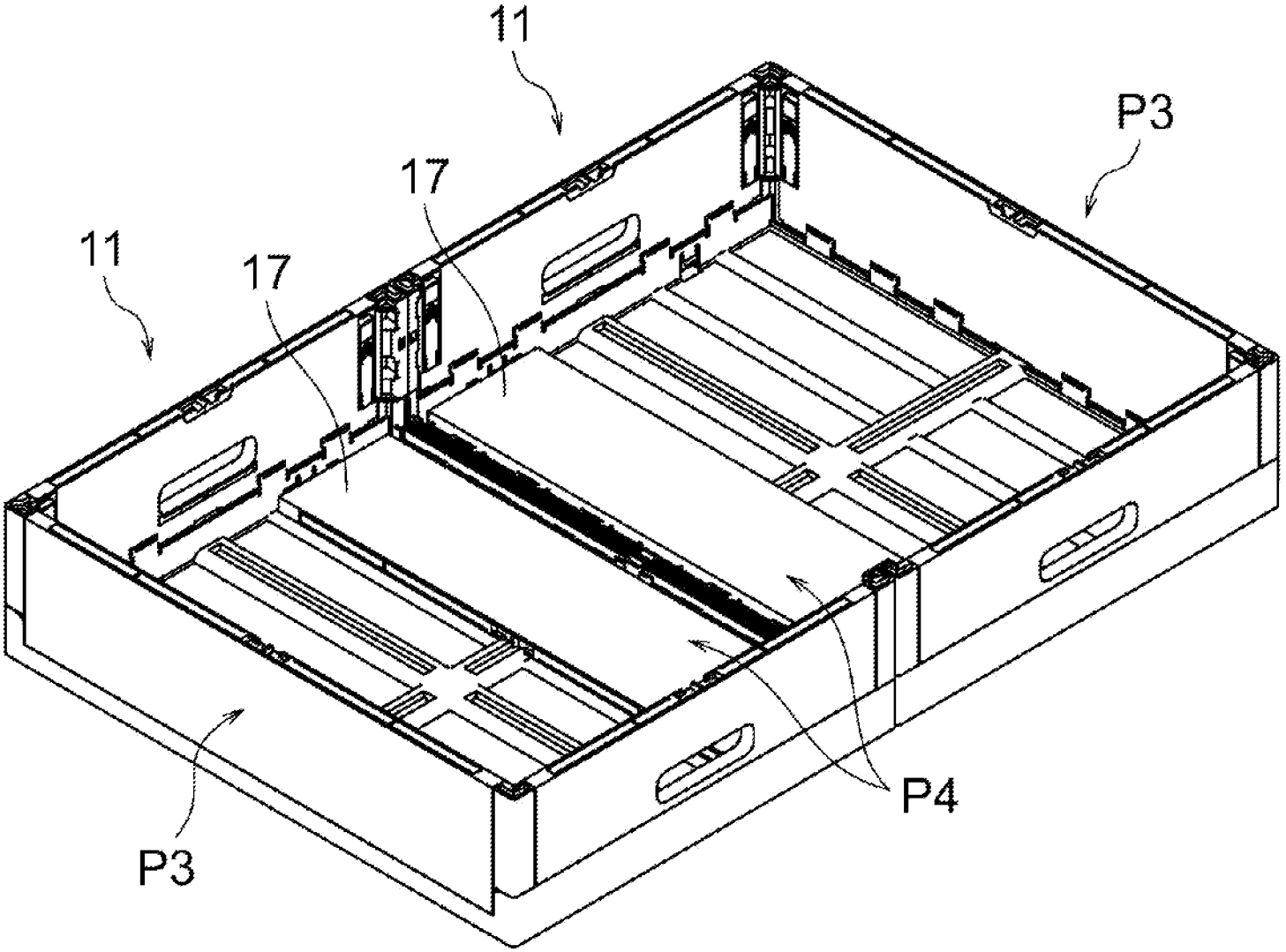
FIG. 19 is a perspective view illustrating paired foldable display cases in a first applicable use mode.

As illustrated in FIG. 19, as a first applicable use mode of the foldable display case 11 according to the present embodiment, the foldable display cases 11 abut on each other while only one of the second side-wall portions 17 of each of the foldable display cases 11 is at the fourth position P4. This enables display of elongated commodities.

Figure 20:
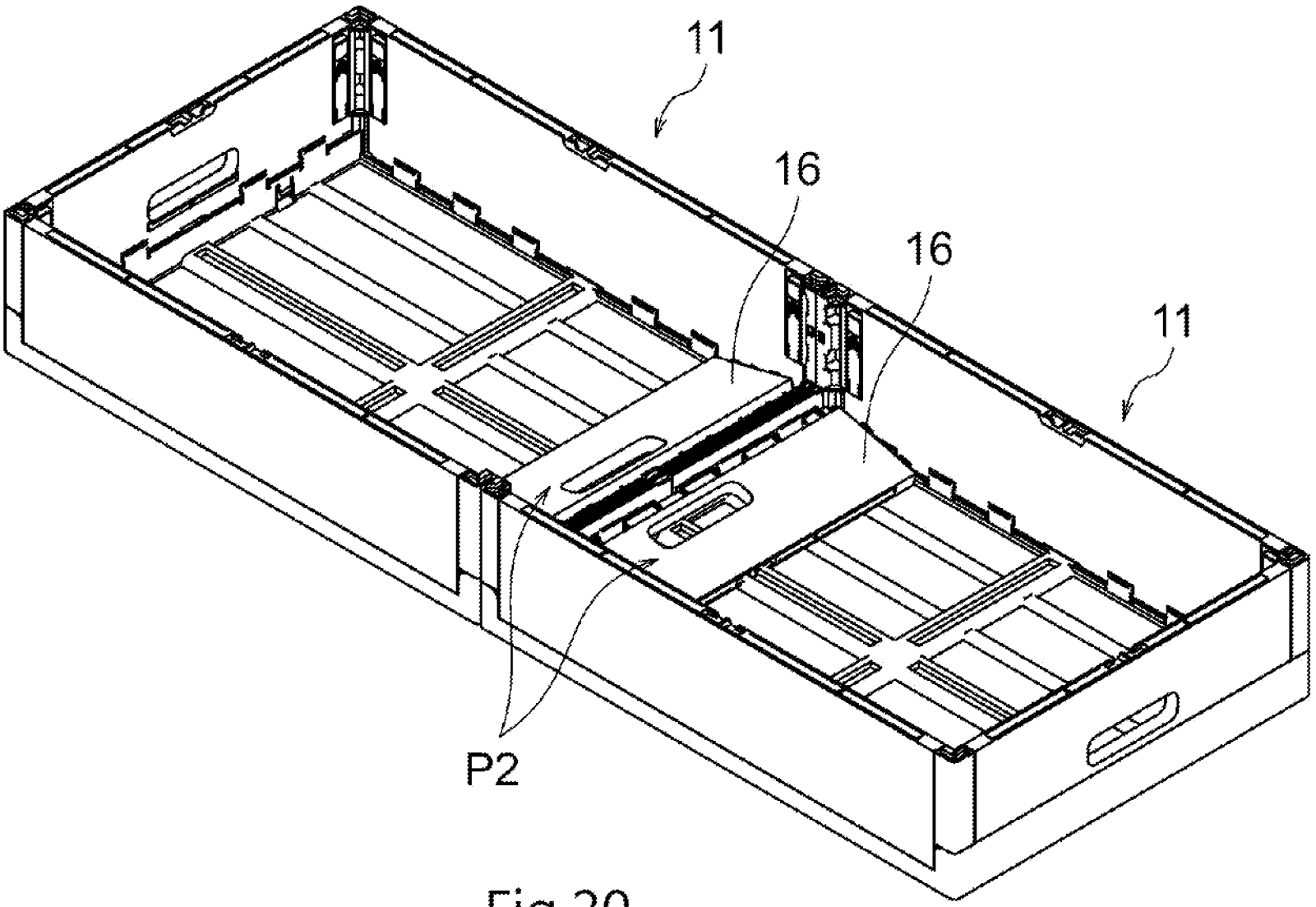
FIG. 20 is a perspective view illustrating paired foldable display cases in a second applicable use mode.

Likewise, as illustrated in FIG. 20, as a second applicable use mode of the foldable display case 11 according to the present embodiment, the foldable display cases 11 abut on each other while only one of the first side-wall portions 16 of each of the foldable display cases 11 is at the second position P2. This enables display of further elongated commodities.

According to the present embodiment, the followings can be said. The foldable display case 11 includes: the case main body 12 having the square plate shape; the first connection portions 14 protruding from the respective first sides 13 along the transverse direction S intersecting the longitudinal direction L of the case main body 12, of the outer end portion of the case main body 12; the second connection portions 15 protruding from the respective second sides 19 along the longitudinal direction L, of the outer edge portion; the first side-wall portions 16 extending along the transverse direction S, each configured to be turnable between the first position P1 where the first side-wall portion 16 stands up from the case main body 12 and the second position P2 where the first side-wall portion 16 falls down on the case main body 12, around the corresponding first connection portion 14, and each including the first engagement portions 43; the second side-wall portions 17 extending along the longitudinal direction L, each configured to be turnable between the third position P3 where the second side-wall portion 17 stands up from the case main body 12 and the fourth position P4 where the second side-wall portion 17 falls down on the case main body 12, around the corresponding second connection portion 15, and each including the second engagement portions 26; and the joint portions 18 provided at the respective corners of the case main body 12, and each including the third engagement portions 53 engageable with and disengageable from the first engagement portions 43 of the turning first side-wall portion 16, and the fourth engagement portions 54 engageable with and disengageable from the second engagement portions 26 of the turning second side-wall portion 17.

According to the configuration, the second side-wall portions 17 along the transverse direction S are set at the fourth position P4 while the second side-wall portions 17 along the longitudinal direction L are kept at the third position P3, which enables the commodities to be easily taken up. Further, the second side-wall portions 17 along the longitudinal direction L are set at the second position P2 while the first side-wall portions 16 along the transverse direction S are kept at the first position P1, which also enables the commodities to be easily taken up. In particular, in a case of the former arrangement that is impossible so far, it is possible to realize display in which elongated commodities such as Japanese radishes, burdocks, and green onions are easily displayed and are easily taken up by a customer.

In this case, either one of the first side-wall portions 16 and the joint portions 18 includes the first latch 45 and the first lever 46 for moving the first latch 45, and the other of the first side-wall portions 16 and the joint portions 18 includes the first hole portion 55 with which the first latch 45 engages.

According to the configuration, it is possible to prevent the first side-wall portions 16 from moving from the first position P1 to the second position P2 by action of the gravity at a time not intended by the user.

In this case, either one of the second side-wall portions 17 and the joint portions 18 includes the second latch 28 and the second lever 31 for moving the second latch 28, and the other of the second side-wall portions 17 and the joint portions 18 includes the second hole portion 56 with which the second latch 28 engages when each of the second side-wall portions 17 is at the third position P3.

According to the configuration, it is possible to prevent the second side-wall portions 17 from moving from the third position P3 to the fourth position P4 by action of the gravity at a time not intended by the user.

In this case, each of the first connection portions 14 includes the fifth engagement portions 21, and the fifth engagement portions 21 engage with the respective second side-wall portions 17 positioned at the fourth position P4 to hold the second side-wall portions 17 at the fourth position P4.

According to the configuration, it is possible to hold the second side-wall portions 17 at the fourth position P4. Therefore, for example, even in a case where the foldable display case 11 is used in the upside-down state where the first side-wall portions 16 and the second side-wall portions 17 are disposed on the lower side of the case main body 12, it is possible to prevent the second side-wall portions 17 from moving from the fourth position P4 to the third position P3 by action of the gravity. Accordingly, the foldable display case 11 used in the upside-down state where the first side-wall portions 16 and the second side-wall portions 17 are disposed on the lower side of the case main body 12 is placed on the foldable display case 11 used in the normal use state where the first side-wall portions 16 and the second side-wall portions 17 are disposed on the upper side of the case main body 12, which enables display in which the front side is largely opened.

In this case, the first connection portions 14 protrude up to the positions farther from the case main body 12 than the second connection portions 15. When each of the first side-wall portions 16 is moved to the second position P2 while the second side-wall portions 17 are at the third position P3, the front end 16A of each of the first side-wall portions 16 is in contact with the case main body 12 to form a slope going away from the case main body 12 as it goes from the front end 16A toward the corresponding first connection portion 14.

According to the configuration, when elongated commodities such as Japanese radishes, burdocks, and green onions are displayed, the elongated commodities can be displayed while being partially placed on the slope. This enables not only three-dimensional display of the commodities, but also display in which the commodities are easily taken up by the customer. Further, two foldable display cases 11 each formed with the slope abut on each other to enable display of further elongated commodities.

In this case, the foldable display case 11 includes the placement portions 22 provided at the respective corners of the case main body 12 and on which the respective joint portions 18 are placed. The placement portions 22 protrude from the case main body 12 up to a height equivalent to a height of the first connection portions 14, and the first connection portions 14 inhibit the joint portions 18 from falling down on the first connection portions 14 together with the second side-wall portions 17.

According to the configuration, the second side-wall portions 17 do not fall down on the first side-wall portions 16 positioned at the second position P2. This makes it possible to reduce a risk causing a defect that the first side-wall portions 16 each forming the slope are damaged by loads from the second side-wall portions 17.

In this case, the first connection portions 14 protrude up to positions farther from the case main body 12 than the second connection portions 15, the first side-wall portions 16 can fall down on the second side-wall portions 17 positioned at the fourth position P4, and the joint portions 18 can fall down on the second connection portions 15 together with the first side-wall portions 16.

According to the configuration, it is possible to compactly fold the foldable display case 11.

In this case, each of the paired second side-wall portions 17 includes the corner portion 32 extending in the longitudinal direction L, the corner portions 32 are in contact with the respective second connection portions 15 when the second side-wall portions 17 are at the third position P1, and are separated from the case main body 12 when the second side-wall portions 17 are at the second position P2, each of the joint portions 18 includes the paired inner surfaces 50 that form an L-shaped cross section and are substantially orthogonal to each other, and the paired inner surfaces 50 of the joint portions 18 are in contact with the corner portions 32 when the paired second side-wall portions 17 are at the fourth position P4.

According to the configuration, the corner portions 32 can be disposed inside the inner surfaces of the joint portions 18. This makes it possible to compactly fold the foldable display case 11.

Subsequently, the foldable display case 11 according to a modification is described with reference to FIG. 21 to FIG. 24. In the following modification, differences from the above-described embodiment are mainly described, and description of portions common to the above-described embodiment is omitted.

Figure 21:
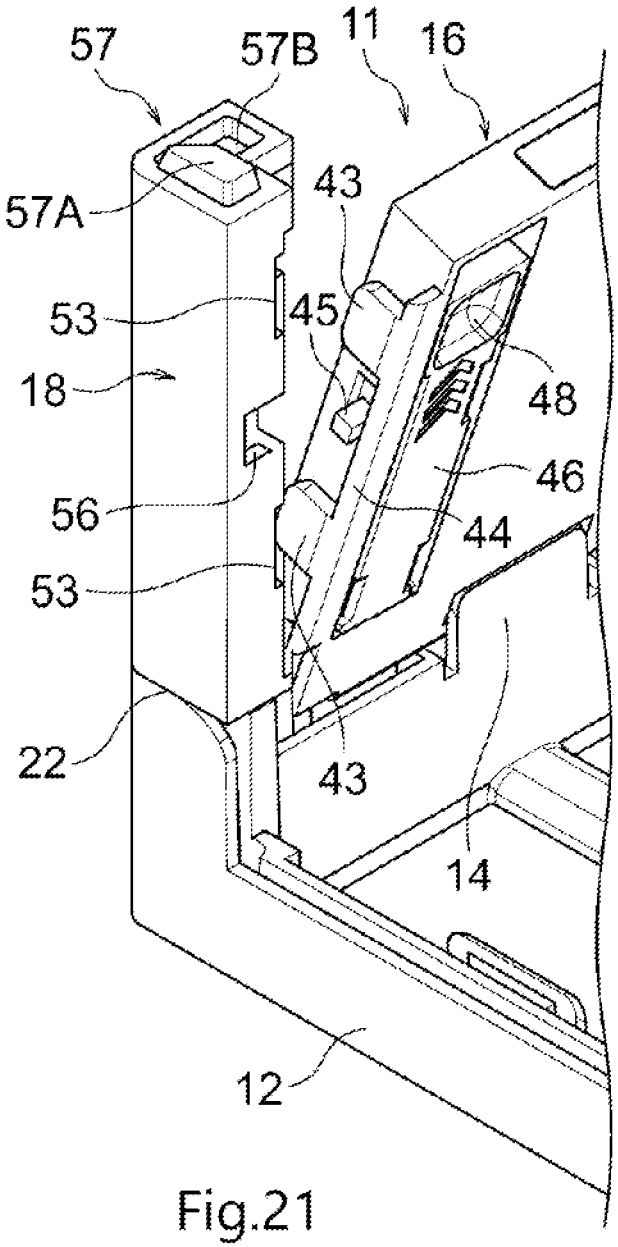
FIG. 21 is a perspective view illustrating a first side-wall portion and a joint portion of a foldable display case according to a modification.
Figure 22:
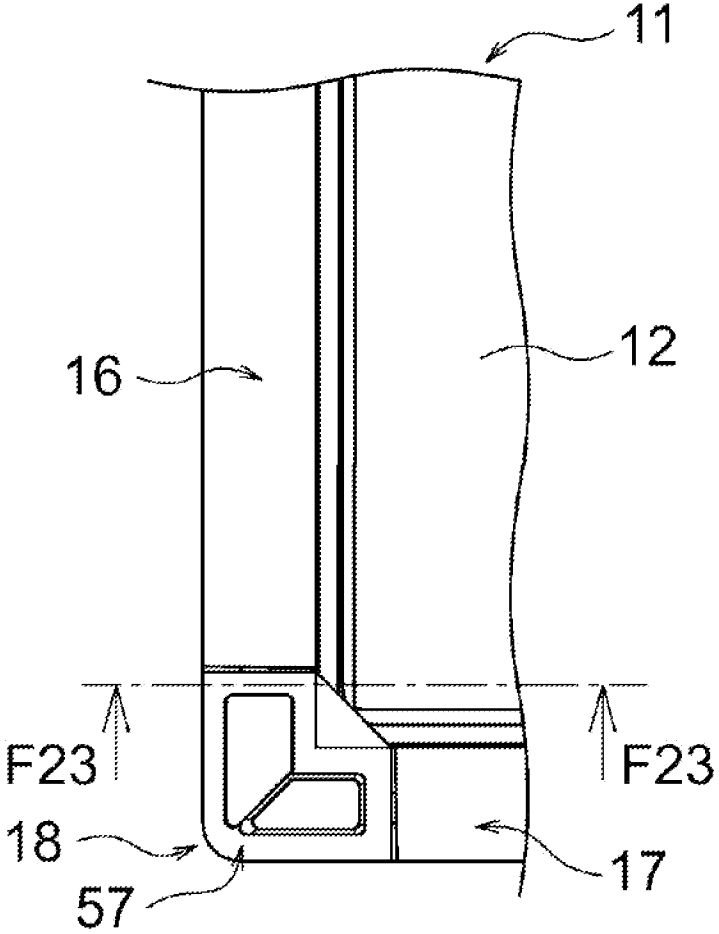
FIG. 22 is a plan view illustrating a part of the foldable display case illustrated in FIG. 21.
Figure 23:
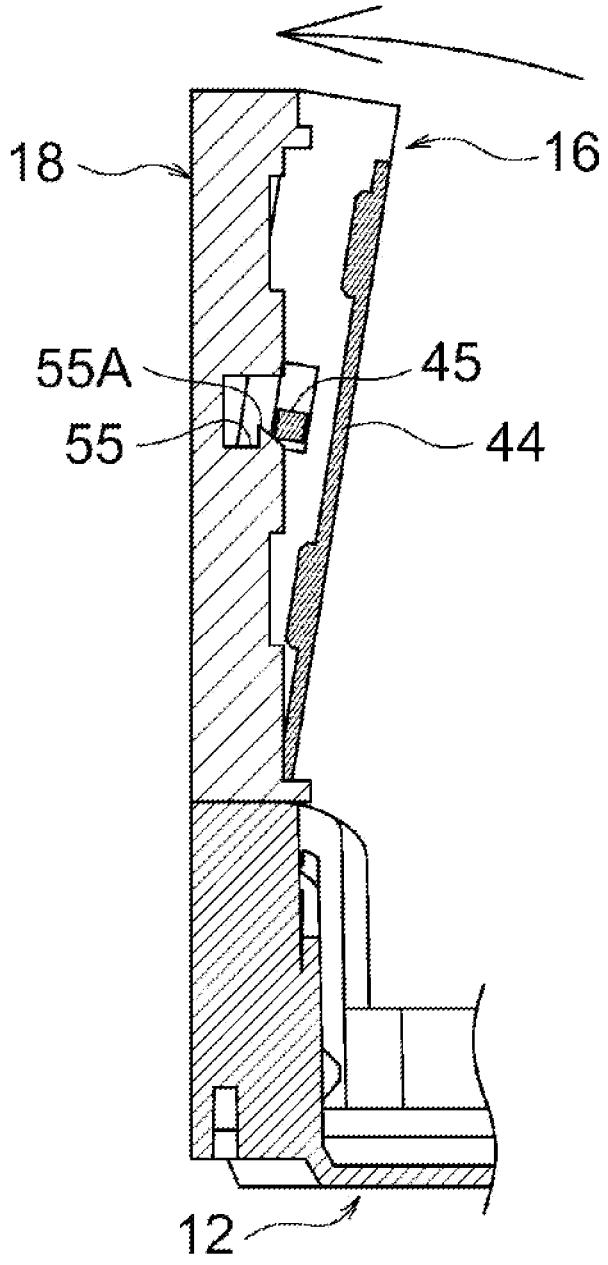
FIG. 23 is a cross-sectional view taken along a position of line F23-F23 of the foldable display case illustrated in FIG. 2.
Figure 24:
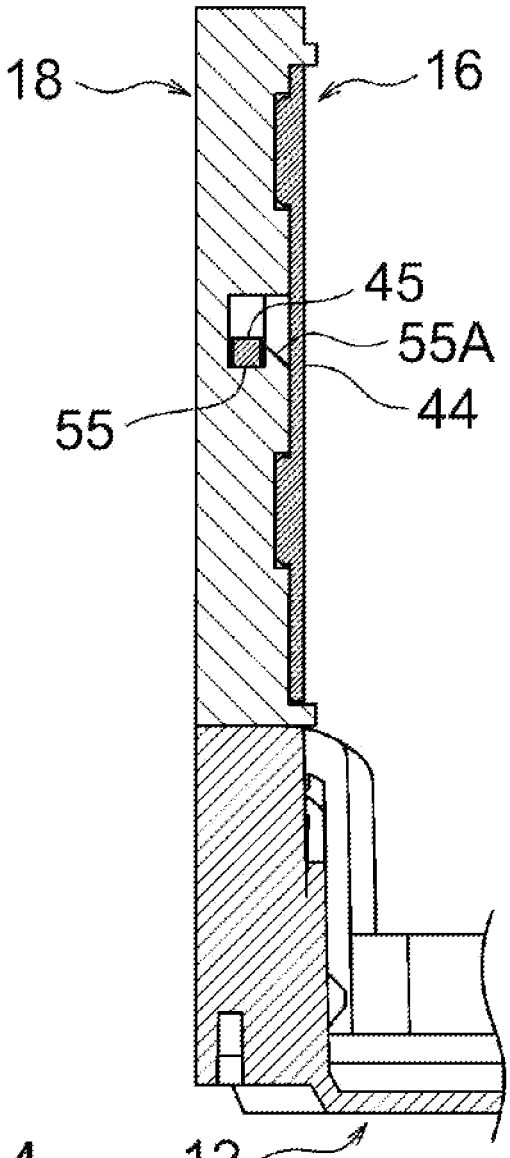
FIG. 24 is a cross-sectional view illustrating a state where the first side-wall portion is moved to a first position in the foldable display case illustrated in FIG. 23.

In the present modification, the first latches 45 and the second latches 28 are formed in the same form. The first hole portions 55 and the second hole portions 56 are formed in the same form. Therefore, in the following, each of the first latches 45 and each of the first hole portions 55 illustrated in FIG. 21 and FIG. 23 are only described.

Each of the first latches 45 is formed in, for example, a columnar shape, and is formed so as to protrude outward from the corresponding opening portion 35 of the first side-wall portion main body 41. The first latches 45 can be vertically moved by operation of the respective first levers 46. In the present modification, the first levers 46 are urged downward by respective unillustrated springs.

Each of the first hole portions 55 is formed as a recess that has a hook-shaped cross-section and into which the corresponding second latch 28 can be fit.

Subsequently, action of the foldable display case 11 according to the modification is described with reference to FIG. 21 to FIG. 24. As illustrated in FIG. 21, to return each of the first side-wall portions 16 from the second position P2 to the first position P1, each of the first latches 45 is in contact with and runs on a corresponding slope 55A provided near an entrance of the corresponding first hole portion 55. As a result, each of the first latches 45 is housed in the corresponding first hole portion 55. Further, at the same time, the first engagement portions 43 engages with the respective third engagement portions 53. As a result, each of the first side-wall portions 16 is held at the first position P1.

In contrast, to move each of the first side-wall portions 16 from the first position P1 to the second position P2, the first lever 46 is pulled upward and the corresponding first latch 45 is accordingly moved upward. As a result, fitting of the first latch 45 into the corresponding first hole portion 55 is released. In this state, the user can move each of the first side-wall portions 16 from the first position P1 to the second position P2.

The above-described embodiment and modifications can be implemented while being added with various replacements and deformations. More specifically, in the above-described embodiment and modifications, the first connection portions 14 protrude to the positions farther from the case main body 12 than the second connection portions 15; however, the form is not limited thereto. For example, the second connection portions 15 may protrude up to positions farther from the case main body 12 than the first connection portions 14 as a matter of course.

REFERENCE SIGNS LIST

11 foldable display case
12 case main body
S transverse direction
13 first side
14 first connection portion
L longitudinal direction
15 second connection portion
16 first side-wall portion
16A front end
17 second side-wall portion
18 joint portion
19 second side
21 fifth engagement portion
22 placement portion
26 second engagement portion
28 second latch
31 second lever
32 corner portion
P3 third position
P4 fourth position
43 first engagement portion
45 first latch
46 first lever
P1 first position
P2 second position
50 inner surface
53 third engagement portion
54 fourth engagement portion
55 first hole portion
56 second hole portion

The invention claimed is:

1. A foldable display case, comprising:

a case main body having a square plate shape;

first connection portions protruding from respective first sides along a transverse direction intersecting a longitudinal direction of the case main body, of an outer edge portion of the case main body;

second connection portions protruding from respective second sides along the longitudinal direction, of the outer edge portion;

first side-wall portions extending along the transverse direction, each configured to be turnable between a first position where the first side-wall portion stands up from the case main body and a second position where the first side-wall portion falls down on the case main body, around the corresponding first connection portion, and each including first engagement portions;

second side-wall portions extending along the longitudinal direction, each configured to be turnable between a third position where the second side-wall portion stands up from the case main body and a fourth position where the second side-wall portion falls down on the case main body, around the corresponding second connection portion, and each including second engagement portions; and joint portions provided at respective corners of the case main body, and each including third engagement portions engageable with and disengageable from the first engagement portions of the turning first side-wall portion, and fourth engagement portions engageable with and disengageable from the second engagement portions of the turning second side-wall portion, wherein each of the paired second side-wall portions includes a corner portion extending in the longitudinal direction, the corner portions are in contact with the respective second connection portions when the second side-wall portions are at the third position, and are separated from the case main body when the second side-wall portions are at the fourth position, each of the joint portions includes paired inner surfaces that form an L-shaped cross-section and are substantially orthogonal to each other, and the paired inner surfaces of the joint portions are in contact with the corner portions when the paired second side-wall portions are at the fourth position.

2. The foldable case according to claim 1, wherein either one of the first side-wall portions and the joint portions includes a first latch and a first lever for moving the first latch, and the other of the first side-wall portions and the joint portions includes a first hole portion with which the first latch engages.

3. The foldable case according to claim 2, wherein either one of the second side-wall portions and the joint portions includes a second latch and a second lever for moving the second latch, and the other of the second side-wall portions and the joint portions includes a second hole portion with which the second latch engages when each of the second side-wall portions is at the third position.

4. The foldable case according to claim 1, wherein the first connection portions protrude up to positions farther from the case main body than the second connection portions, and when each of the first side-wall portions is moved to the second position while the second side-wall portions are at the third position, a front end of each of the first side-wall portions is in contact with the case main body to form a slope going away from the case main body as it goes from the front end toward the corresponding first connection portion.

5. The foldable display case according to claim 4, further comprising placement portions provided at respective corners of the case main body and on which the respective joint portions are placed, wherein the placement portions protrude from the case main body up to a height equivalent to a height of the first connection portions, and the first connection portions inhibit the joint portions from falling down on the first connection portions together with the second side-wall portions.

6. The foldable display case according to claim 1, wherein the first connection portions protrude up to positions farther from the case main body than the second connection portions, the first side-wall portions are configured to fall down on the second side-wall portions positioned at the fourth position, and the joint portions are configured to fall down on the second connection portions together with the first side-wall portions.

7. A foldable display case, comprising:

a case main body having a square plate shape;

first connection portions protruding from respective first sides along a transverse direction intersecting a longitudinal direction of the case main body, of an outer edge portion of the case main body;

second connection portions protruding from respective second sides along the longitudinal direction, of the outer edge portion;

first side-wall portions extending along the transverse direction, each configured to be turnable between a first position where the first side-wall portion stands up from the case main body and a second position where the first side-wall portion falls down on the case main body, around the corresponding first connection portion, and each including first engagement portions;

second side-wall portions extending along the longitudinal direction, each configured to be turnable between a third position where the second side-wall portion stands up from the case main body and a fourth position where the second side-wall portion falls down on the case main body, around the corresponding second connection portion, and each including second engagement portions; and joint portions provided at respective corners of the case main body, and each including third engagement portions engageable with and disengageable from the first engagement portions of the turning first side-wall portion, and fourth engagement portions engageable with and disengageable from the second engagement portions of the turning second side-wall portion, wherein each of the first connection portions includes fifth engagement portions, and the fifth engagement portions engage with the respective second side-wall portions positioned at the fourth position to hold the second side-wall portions at the fourth position.

* * * * *